US011130357B2

(12) United States Patent
Mizutani

(10) Patent No.: US 11,130,357 B2
(45) Date of Patent: Sep. 28, 2021

(54) PRINTER

(71) Applicant: BROTHER KOGYO KABUSHIKI KAISHA, Nagoya (JP)

(72) Inventor: Hiromitsu Mizutani, Ichinomiya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 275 days.

(21) Appl. No.: 16/453,611

(22) Filed: Jun. 26, 2019

(65) Prior Publication Data

US 2020/0101773 A1 Apr. 2, 2020

(30) Foreign Application Priority Data

Sep. 28, 2018 (JP) ..... JP2018-183220

(51) Int. Cl.

| | |
|---|---|
| ***B41J 11/70*** | (2006.01) |
| ***B65H 5/06*** | (2006.01) |
| ***B41J 29/38*** | (2006.01) |
| ***B41J 3/407*** | (2006.01) |
| ***G03G 15/20*** | (2006.01) |
| ***G03G 15/00*** | (2006.01) |
| ***B41J 15/04*** | (2006.01) |

(52) U.S. Cl.

CPC ..... *B41J 11/70* (2013.01); *B41J 3/4075* (2013.01); *B41J 15/04* (2013.01); *B41J 29/38* (2013.01); *B65H 5/06* (2013.01); *G03G 15/2028* (2013.01); *G03G 15/6561* (2013.01)

(58) Field of Classification Search

CPC . B41J 11/70; B41J 3/4075; B41J 15/04; B41J 29/38; B65H 5/06; G03G 15/2028; G03G 15/6561

See application file for complete search history.

(56) References Cited

U.S. PATENT DOCUMENTS

| | | | | |
|---|---|---|---|---|
| 10,696,073 | B2 * | 6/2020 | Mizutani | B41J 11/666 |
| 2012/0048079 | A1 * | 3/2012 | Mitsuhashi | B65H 35/04 83/13 |
| 2019/0299657 | A1 * | 10/2019 | Mizutani | B41J 11/04 |

FOREIGN PATENT DOCUMENTS

| | | | |
|---|---|---|---|
| JP | 2003-276259 | A | 9/2003 |

* cited by examiner

*Primary Examiner* — David H Banh
(74) *Attorney, Agent, or Firm* — Kenealy Vaidya LLP

(57) ABSTRACT

A printer includes: a conveyor; a printing device; a full-cut unit provided downstream of the printing device; a roller provided downstream of the full-cut unit; a nip member; a motor; and a controller configured to: control the full-cut unit to fully cut the printing medium; control the motor to establish a state in which a leading printing medium is nipped between the roller and the nip member; and control the conveyor to convey a succeeding printing medium downstream while controlling the printing device to perform printing on the succeeding printing medium.

27 Claims, 23 Drawing Sheets

PRINTER

CROSS REFERENCE TO RELATED APPLICATION

The present application claims priority from Japanese Patent Application No. 2018-183220, which was filed on Sep. 28, 2018, the disclosure of which is herein incorporated by reference in its entirety.

BACKGROUND

The following disclosure relates to a printer.

Printers for performing printing on a printing medium are known. One example of the printers is a ticket issuing device. The ticket issuing device includes a supply unit, a printing unit, a cutting unit, an output unit, and an output opening. The printing unit performs printing on a sheet supplied from the supply unit. The cutting unit cuts the printed sheet to create a numbered ticket. The output unit includes a pair of conveying rollers opposed to each other. The pair of conveying rollers convey the nipped numbered ticket from the output opening toward the outside. The numbered ticket protrudes from the output opening to the outside in a state in which the numbered ticket is held by the pair of conveying rollers. When the numbered ticket is taken out from the output opening, the ticket issuing device performs printing on a succeeding sheet supplied from the supply unit.

SUMMARY

In the above-described ticket issuing device, however, the numbered ticket needs to be taken out from the output opening to start printing on a succeeding sheet. This leads to a possibility that the ticket issuing device cannot perform printing on the sheet for a short time.

Accordingly, an aspect of the disclosure relates to a printer capable of performing printing on a printing medium for a short time.

In one aspect of the disclosure, a printer includes: a conveyor configured to convey a printing medium; a printing device configured to perform printing on the printing medium conveyed by the conveyor; a full-cut unit provided downstream of the printing device in a conveying direction in which the printing medium is conveyed, the full-cut unit being configured to fully cut the printing medium; a roller provided downstream of the full-cut unit in the conveying direction; a nip member configured to cooperate with the roller to nip the printing medium therebetween; a motor configured to drive the roller; and a controller configured to execute: a full-cut processing in which the controller controls the full-cut unit to fully cut the printing medium into a leading printing medium located downstream of the full-cut unit in the conveying direction and a succeeding printing medium located upstream of the full-cut unit in the conveying direction; a particular processing in which the controller controls the motor to establish a state in which the leading printing medium is nipped between the roller and the nip member; and a printing and conveying processing in which the controller controls the conveyor to convey the succeeding printing medium downstream in the conveying direction while controlling the printing device to perform printing on the succeeding printing medium in the state in which the leading printing medium is nipped between the roller and the nip member.

In another aspect of the disclosure, a printer includes: a conveyor configured to convey a printing medium; a printing device configured to perform printing on the printing medium conveyed by the conveyor; a full-cut unit provided downstream of the printing device in a conveying direction in which the printing medium is conveyed, the full-cut unit being configured to fully cut the printing medium; a roller provided downstream of the full-cut unit in the conveying direction; a nip member configured to cooperate with the roller to nip the printing medium therebetween; a motor configured to drive the roller; and a controller configured to execute: a full-cut processing in which the controller controls the full-cut unit to fully cut the printing medium into a leading printing medium located downstream of the full-cut unit in the conveying direction and a succeeding printing medium located upstream of the full-cut unit in the conveying direction; a particular processing in which the controller controls the motor to establish a state in which the leading printing medium is nipped between the roller and the nip member; and a backward conveying processing in which the controller controls the conveyor to convey the succeeding printing medium upstream in the conveying direction in the state in which the leading printing medium is nipped between the roller and the nip member.

In yet another aspect of the disclosure, a printer includes: a conveyor configured to convey a printing medium; a printing device configured to perform printing on the printing medium conveyed by the conveyor; a full-cut unit provided downstream of the printing device in a conveying direction in which the printing medium is conveyed, the full-cut unit being configured to fully cut the printing medium; a roller provided downstream of the full-cut unit in the conveying direction; a nip member configured to cooperate with the roller to nip the printing medium therebetween; a motor configured to drive the roller; and a controller configured to execute: a full-cut processing in which the controller controls the full-cut unit to fully cut the printing medium into a leading printing medium located downstream of the full-cut unit in the conveying direction and a succeeding printing medium located upstream of the full-cut unit in the conveying direction; an obtaining processing in which the controller obtains one of a plurality of pieces of distance information which are different from each other and each of which indicates a distance less than a first distance in the conveying direction from a full-cut position at which the printing medium is fully cut by the full-cut unit, to a nipping position at which the printing medium is nipped between the roller and the nip member; and a particular processing in which the controller controls the motor to convey the leading printing medium downstream in the conveying direction by a distance indicated by the distance information obtained in the obtaining processing, to establish a state in which the leading printing medium is nipped between the roller and the nip member.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

DETAILED DESCRIPTION OF THE EMBODIMENT

Figure 1:
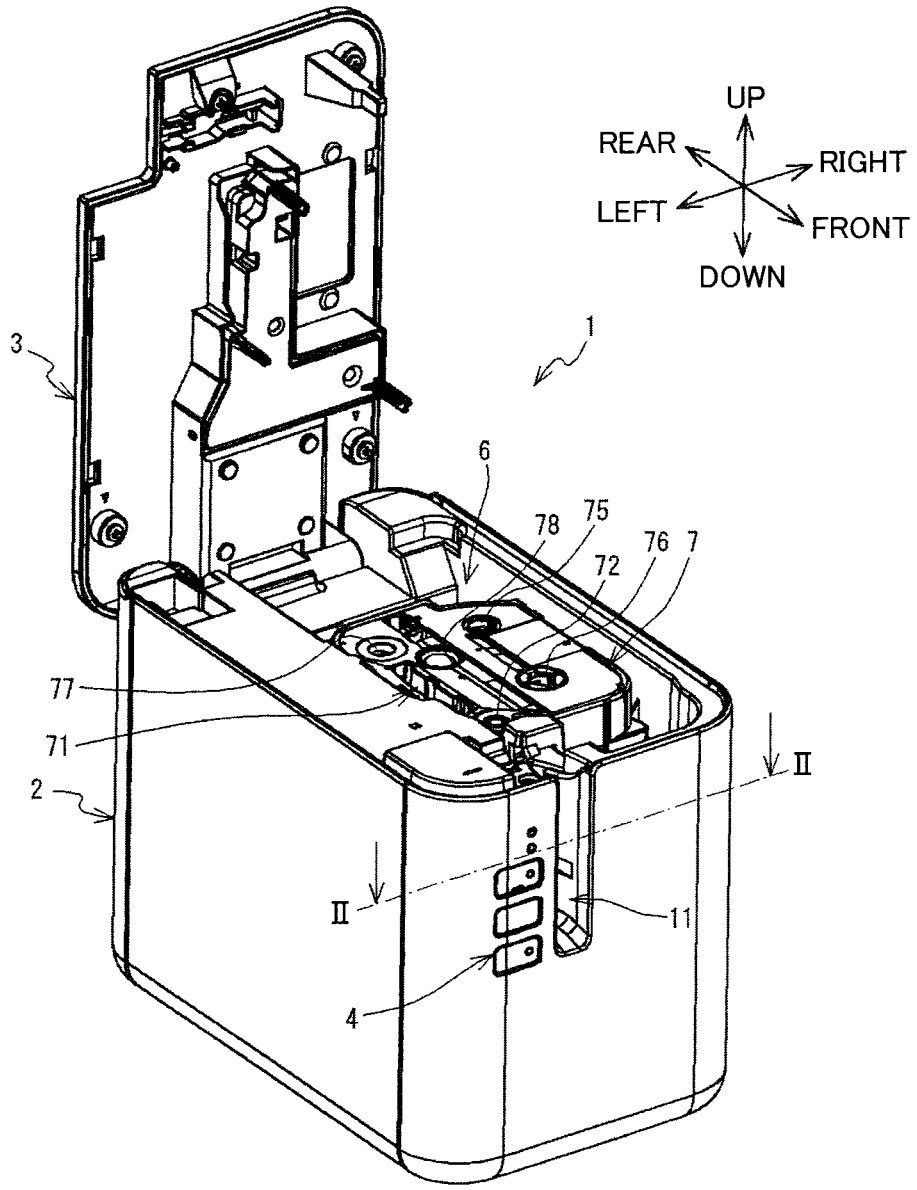
FIG. 1 is a perspective view of a printer.

Hereinafter, there will be described one embodiment by reference to the drawings. The drawings are for explanation of technical features employable in the present disclosure. It is to be understood that the configuration illustrated in the drawings does not limit the present disclosure and is only one example. It is further noted that teeth of gears are not illustrated in the drawings for simplicity.

There will be described a configuration of a printer 1 with reference to FIGS. 1 and 2. The lower left side, the upper right side, the lower right side, the upper left side, the upper side, and the lower side in FIG. 1 are defined respectively as the left side, the right side, the front side, the rear side, the upper side, and the lower side of the printer 1. The printer 1 prints characters on a printing medium 5. The printing medium 5 is a tape in the present embodiment. Examples of the characters include letters, numbers, signs, and marks. It is noted that the printing medium 5 is not hatched in FIGS. 2, 6, 7, 10-12, and 14-23.

The printer 1 is connectable to external terminals, not illustrated, via any of a network and a cable, not illustrated, for example. Examples of the external terminals include a personal computer and a smartphone. For example, the printer 1 obtains printing information transmitted from the external terminal. The printing information indicates characters.

As illustrated in FIG. 1, the printer 1 includes a housing 2 and a cover 3. The housing 2 has a substantially rectangular parallelepiped shape. The cover 3 is pivotably supported by a rear end portion of an upper surface of the housing 2 and opened and closed with respect to the upper surface of the housing 2. An input interface 4 is provided at an upper left corner portion of a front surface of the housing 2. The input interface 4 includes buttons for inputting various kinds of information to the printer 1. An output opening 11 is formed in the front surface of the housing 2 at a position located to the right of the input interface 4. The output opening 11 extends in the up and down direction and communicates with the inside and the outside of the housing 2. The upper surface of the housing 2 has a mount portion 6. The mount portion 6 is recessed downward from the upper surface of the housing 2. The cassette 7 is removably mountable in the mount portion 6.

Figure 2:
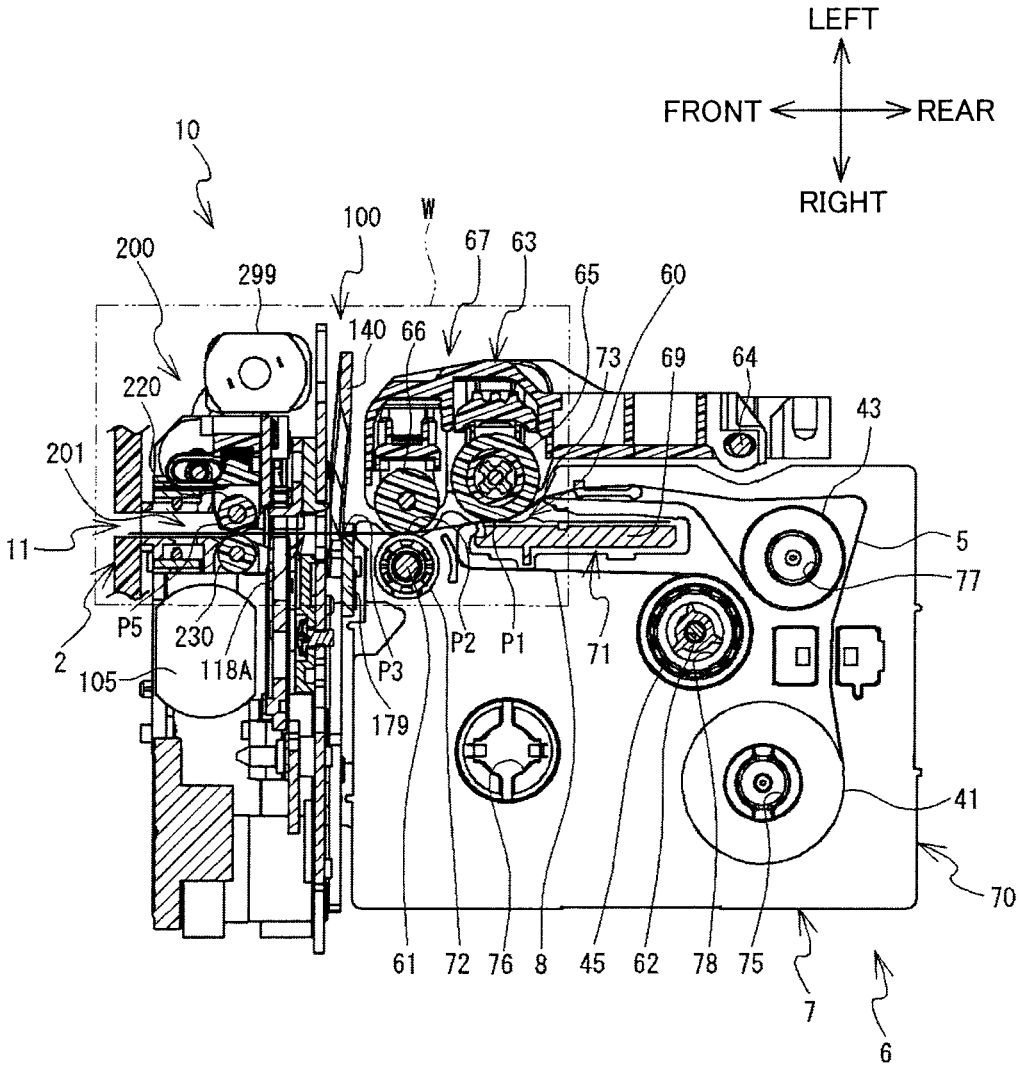
FIG. 2 is a cross-sectional view taken along line II-II in FIGS. 1 and 3 and viewed in the direction indicated by the arrows.

As illustrated in FIG. 2, the mount portion 6 is provided with a thermal head 60, a driving shaft 61, and a ribbon take-up shaft 62. The thermal head 60 is provided on a left surface of a head holder 69 and includes a plurality of heating elements arranged in the up and down direction. The head holder 69 is shaped like a plate provided on a left portion of the mount portion 6 and extending in a direction orthogonal to the right and left direction. The driving shaft 61 is rotatably disposed in front of the head holder 69 so as to extend in the up and down direction. The ribbon take-up shaft 62 is rotatably disposed to the right of the head holder 69 and extends in the up and down direction.

A platen holder 63 is provided to the left of the mount portion 6. A rear end portion of the platen holder 63 is rotatably supported by a shaft 64. The shaft 64 extends in the up and down direction. The platen holder 63 supports a platen roller 65 and a conveying roller 66 rotatably in the clockwise direction and the counterclockwise direction in plan view, respectively. The platen roller 65 is disposed to the left of and opposed to the thermal head 60. The conveying roller 66 is provided in front of the platen roller 65 and to the left of the driving shaft 61. The conveying roller 66 is opposed to the driving shaft 61. The platen holder 63 pivots about the shaft 64 such that a front end portion of the platen holder 63 moves substantially in the right and left direction. This movement moves each of the platen roller 65 and the conveying roller 66 between a position (see FIG. 2) at which each of the platen roller 65 and the conveying roller 66 is located near a corresponding one of the thermal head 60 and the driving shaft 61 and a position, not illustrated, at which each of the platen roller 65 and the conveying roller 66 is located far from the corresponding one of the thermal head 60 and the driving shaft 61.

The driving shaft 61, the ribbon take-up shaft 62, the platen roller 65, and the conveying roller 66 are coupled to a conveying motor 68 (see FIG. 8) via gears, not illustrated. The conveying motor 68 is driven so as to be rotated in any of a forward-conveyance direction and a backward-conveyance direction. The forward-conveyance direction and the backward-conveyance direction are rotational directions reverse to each other. The conveying motor 68, the gears, the platen roller 65, and the conveying roller 66 constitute a conveyor 67 configured to convey the printing medium 5.

An internal unit 10 is provided in the housing 2 at a position near a rear portion of the output opening 11. The internal unit 10 includes a cutting unit 100 and an output unit 200. The cutting unit 100 performs a cutting operation for cutting the printing medium 5. The cutting operation performed by the cutting unit 100 includes a full cut of the printing medium 5. The full cut of the printing medium 5 is an operation of completely cutting the printing medium 5 in two parts. The full cut in the present embodiment is an operation of cutting the printing medium 5 in the form of a sheet across its width and thickness.

Figure 8:
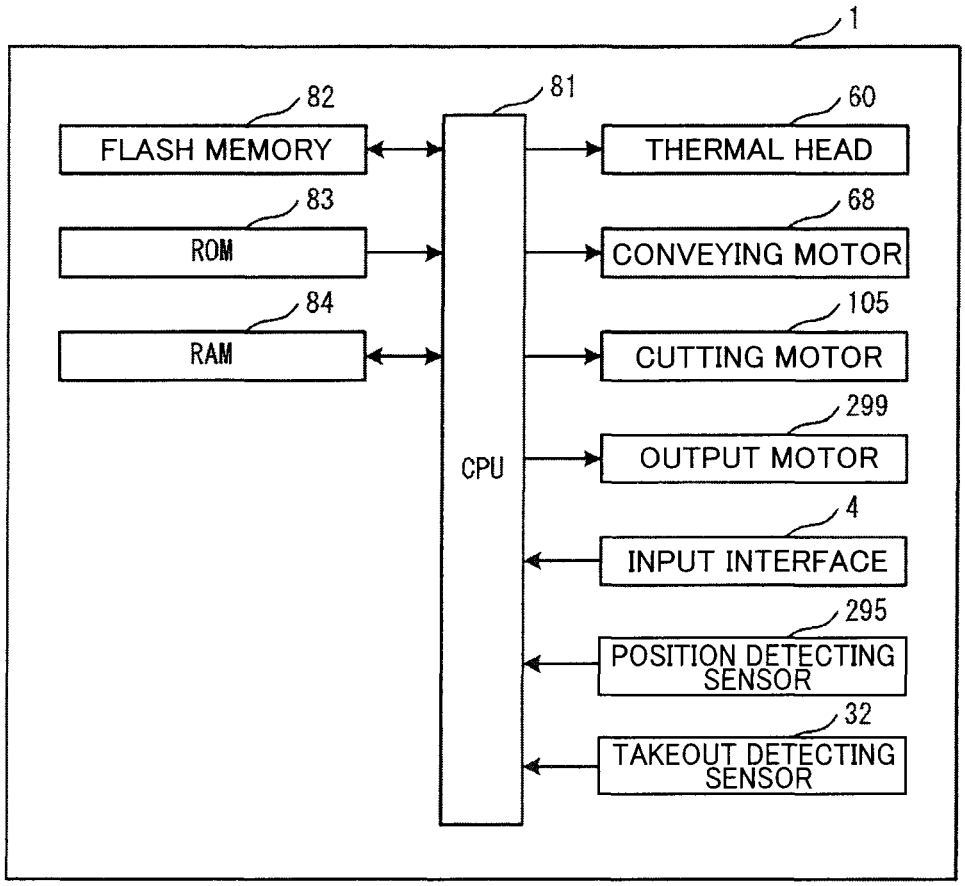
FIG. 8 is a block diagram illustrating an electric configuration of the printer.

The cutting unit 100 includes a fixed blade 179, a full-cut blade 140, and a cutting motor 105 (see FIG. 8). The printing medium 5 is placed on the fixed blade 179. The full-cut blade 140 is located to the left of and opposed to the fixed blade 179. The fixed blade 179 is provided to the right of the full-cut blade 140. Driving of the cutting motor 105 allows the full-cut blade 140 to move between a distant position (see FIG. 2) and a cutting position, not illustrated. The distant position is located to the left of the fixed blade 179. At this position, the full-cut blade 140 is spaced apart from the fixed blade 179. At the full-cut position, the full-cut blade 140 performs the full cut of the printing medium 5 located between the full-cut blade 140 and the fixed blade 179. In the following description, the wordings "the full-cut blade 140 performs the full cut of the printing medium 5" may be referred to as "the full-cut blade 140 fully cuts the printing medium 5".

There will be next described the cassette 7 with reference to FIG. 2. The configuration of the cassette 7 will be described with reference to a state in which the cassette 7 is mounted in the mount portion 6. The cassette 7 includes a casing 70. The casing 70 is shaped like a box and includes a driving roller 72 and support holes 75-78. The driving roller 72 is a cylindrical member disposed at a front left corner portion of the casing 70 so as to extend in the up and down direction. The driving roller 72 is rotatably supported by the casing 70. The driving shaft 61 is inserted in the driving roller 72. A left end portion of the driving roller 72 is exposed from the casing 70 to the outside. The left end portion of the driving roller 72 and the conveying roller 66 nip the printing medium 5 therebetween.

The support hole 75 is formed through the casing 70 in the up and down direction. The support hole 75 supports a first tape spool 41 such that the first tape spool 41 is rotatable. The first tape spool 41 extends in the up and down direction. The printing medium 5 is wound around the first tape spool 41. The printing medium 5 fed from the first tape spool 41 is drawn from a tape output opening 73. The tape output opening 73 is formed at a front end of a left end portion of the casing 70 and opened frontward. The printing medium 5 drawn from the tape output opening 73 is conveyed toward the internal unit 10 via a space located between the platen roller 65 and the thermal head 60, and a space located between the conveying roller 66 and the driving roller 72.

The support hole 76 is formed through the casing 70 in the up and down direction. The support hole 76 supports a second tape spool, not illustrated, such that the second tape spool is rotatable. The second tape spool extends in the up and down direction. A printing medium, not illustrated, different from the printing medium 5 is wound around the second tape spool. The support hole 77 is formed through the casing 70 in the up and down direction. The support hole 77 supports a ribbon spool 43 such that the ribbon spool 43 is rotatable. The ribbon spool 43 extends in the up and down direction. An ink ribbon 8 having not yet been used for printing is wound around the ribbon spool 43. The support hole 78 is formed through the casing 70 in the up and down direction. The support hole 78 supports a ribbon take-up spool 45 such that the ribbon take-up spool 45 is rotatable. The ribbon take-up spool 45 is a cylindrical member extending in the up and down direction. The ink ribbon 8 having already been used for printing is taken up and wound around the ribbon take-up spool 45. The ribbon take-up shaft 62 is inserted in the ribbon take-up spool 45. The ink ribbon 8 fed from the ribbon spool 43 is drawn from the tape output opening 73. The drawn ink ribbon 8 passes through a space between the printing medium 5 and the thermal head 60, enters again into the casing 70, and is taken up by the ribbon take-up spool 45.

The casing 70 has a head opening 71. The head opening 71 is formed through a left portion of the casing 70 in the up and down direction at a position located to the right of the tape output opening 73. The head holder 69 and the thermal head 60 are inserted into the head opening 71. The printing medium 5 and the ink ribbon 8 drawn from the tape output opening 73 passes through a front left portion of the head opening 71.

The cassette 7, which is of a receptor type, contains a receptor tape as the printing medium 5. The support hole 75 supports the first tape spool 41 around which the printing medium 5 is wound. In the case of the cassette 7 of the receptor type, tapes of other types cannot be used, and accordingly the support hole 76 does not support the second tape spool, not illustrated. The support hole 77 supports the ribbon spool 43. Explanations are omitted for configurations of the cassette 7 in the case where the cassette 7 is of a thermal type and the case where the cassette 7 is of a laminate type.

When the cover 3 is closed, the platen roller 65 and the conveying roller 66 are respectively moved to positions located near and to the left of the thermal head 60 and the driving shaft 61. As a result, the platen roller 65 presses the printing medium 5 and the ink ribbon 8 against the thermal head 60 in a state in which the ink ribbon 8 is placed on the printing medium 5. The conveying roller 66 presses the printing medium 5 against the driving roller 72. The state in which the cassette 7 is mounted on the mount portion 6, and the cover 3 is closed may be hereinafter referred to as "printing prepared state".

Hereinafter, a direction in which the printing medium 5 is conveyed may be referred to as "conveying direction". A position in the conveying direction at which the tape is nipped between the platen roller 65 and the thermal head 60 will be referred to as "printing position P1". A position in the conveying direction at which the printing medium 5 is nipped between the conveying roller 66 and the driving roller 72 may be referred to as "roller nipping position P2". Hereinafter, the downstream side and the upstream side in the conveying direction may be hereinafter simply referred to as "downstream side" and "upstream side", respectively. A downstream end portion and an upstream end portion of the printing medium 5 may be hereinafter referred to as "leading end portion" and "trailing end portion", respectively.

The printer 1 rotates the driving shaft 61, the platen roller 65, and the conveying roller 66 to convey the printing medium 5. The wording "conveyance" in the present embodiment includes forward conveyance and backward conveyance. The forward conveyance is conveyance of the printing medium 5 downstream in the conveying direction. That is, the forward conveyance is conveyance of the printing medium 5 such that the printing medium 5 is drawn from the first tape spool 41. The backward conveyance is conveyance of the printing medium 5 upstream in the conveying direction.

In the case where the printer 1 conveys the printing medium 5 forward, at least a portion of the printing medium 5 is nipped between the platen roller 65 and the thermal head 60. The printer 1 rotates the conveying motor 68 (see FIG. 8) in the forward-conveyance direction to rotate the driving shaft 61 in the counterclockwise direction in plan view and rotate the platen roller 65 and the conveying roller 66 in the clockwise direction in plan view. In this case, the driving roller 72 is rotated in the counterclockwise direction in plan view. As a result, the printing medium 5 is conveyed forward (that is, the printing medium 5 is conveyed downstream in the conveying direction). The printing medium 5 being conveyed forward passes through a region between the conveying roller 66 and the platen roller 65.

In the case where the printer 1 conveys the printing medium 5 backward, at least a portion of the printing medium 5 is nipped between the platen roller 65 and the thermal head 60. The printer 1 rotates the conveying motor 68 in the backward-conveyance direction to rotate the driving shaft 61 in the clockwise direction in plan view and rotate the platen roller 65 and the conveying roller 66 in the counterclockwise direction in plan view. In this case, the driving roller 72 is rotated in the clockwise direction in plan view. As a result, the printing medium 5 is conveyed backward (that is, the printing medium 5 is conveyed upstream in the conveying direction).

The printer 1 performs a leading-end positioning operation before performing a printing operation. In the leading-end positioning operation, the printer 1 controls the conveying motor 68 to perform at least the backward-conveyance operation among the backward-conveyance operation and the forward-conveyance operation. As a result, leading-end positioning of the printing medium 5 is performed.

After the end of the leading-end positioning operation, the printer 1 performs the printing operation. In the printing operation, the printer 1 performs printing on the printing medium 5 while conveying the printing medium 5 forward. Specifically, the printer 1 generates heat in the thermal head 60 to heat the ink ribbon 8. This operation thermally transfers the ink of the ink ribbon 8 to the printing medium 5, whereby characters are printed at the printing position P1. The printer 1 rotates the conveying motor 68 in the forward-conveyance direction to rotate the ribbon take-up shaft 62, the driving shaft 61, the platen roller 65, and the conveying roller 66. The rotation of the ribbon take-up shaft 62 rotates the ribbon take-up spool 45, whereby the ribbon take-up spool 45 takes up the ink ribbon 8. The rotation of the driving shaft 61 rotates the driving roller 72 in the counterclockwise direction in plan view. The printing medium 5 nipped between the conveying roller 66 and the driving roller 72 at the roller nipping position P2 is conveyed forward by rotations of the driving roller 72 and the conveying roller 66. The printing medium 5 nipped between the platen roller 65 and the thermal head 60 is conveyed forward by rotation of the platen roller 65.

After discharged from the cassette 7, the printing medium 5 on which the characters are printed is conveyed forward toward the internal unit 10. The printing medium 5 on which the characters are printed is nipped between an output roller 220 and an opposed roller 230 of the output unit 200 which will be described below (see FIG. 11). As will be described below, a position, in the conveying direction, at which the printing medium 5 is nipped between the output roller 220 and the opposed roller 230 is a nipping position P5. The printing medium 5 nipped between the output roller 220 and the opposed roller 230 is cut at a full-cut position P3 by the full-cut blade 140 moved from the distant position to the cutting position (see FIG. 12). The printing medium 5 nipped at the nipping position P5 is conveyed by the output unit 200 toward the output opening 11.

In the following description, the distance in the conveying direction from the full-cut position P3 to the nipping position P5 will be referred to as "first distance" (the dimension L1 in FIG. 7). The distance in the conveying direction from the full-cut position P3 to a trailing end portion of the printing medium 5 fully cut and located downstream of the full-cut position P3 in the conveying direction, i.e., the trailing end portion of a leading printing medium 5A which will be described below, will be referred to as "second distance" (the dimension L2 in FIG. 15). The distance in the conveying direction from the printing position P1 to the full-cut position P3 will be referred to as "third distance" (the dimension L3 in FIG. 7). The distance in the conveying direction from the printing position P1 to the nipping position P5 will be referred to as "fourth distance" (the dimension L4 in FIG. 7). The distance in the conveying direction from the printing position P1 to the trailing end portion of the leading printing medium 5A will be referred to as "fifth distance" (the dimension L5 in FIG. 22). Each of the second distance and the fifth distance changes in accordance with a distance by which the printing medium 5 located downstream of the full-cut position P3 is discharged by the output unit 200 (i.e., in accordance with processings at S31, S33, and S37 in a main process which will be described below).

Figure 3:
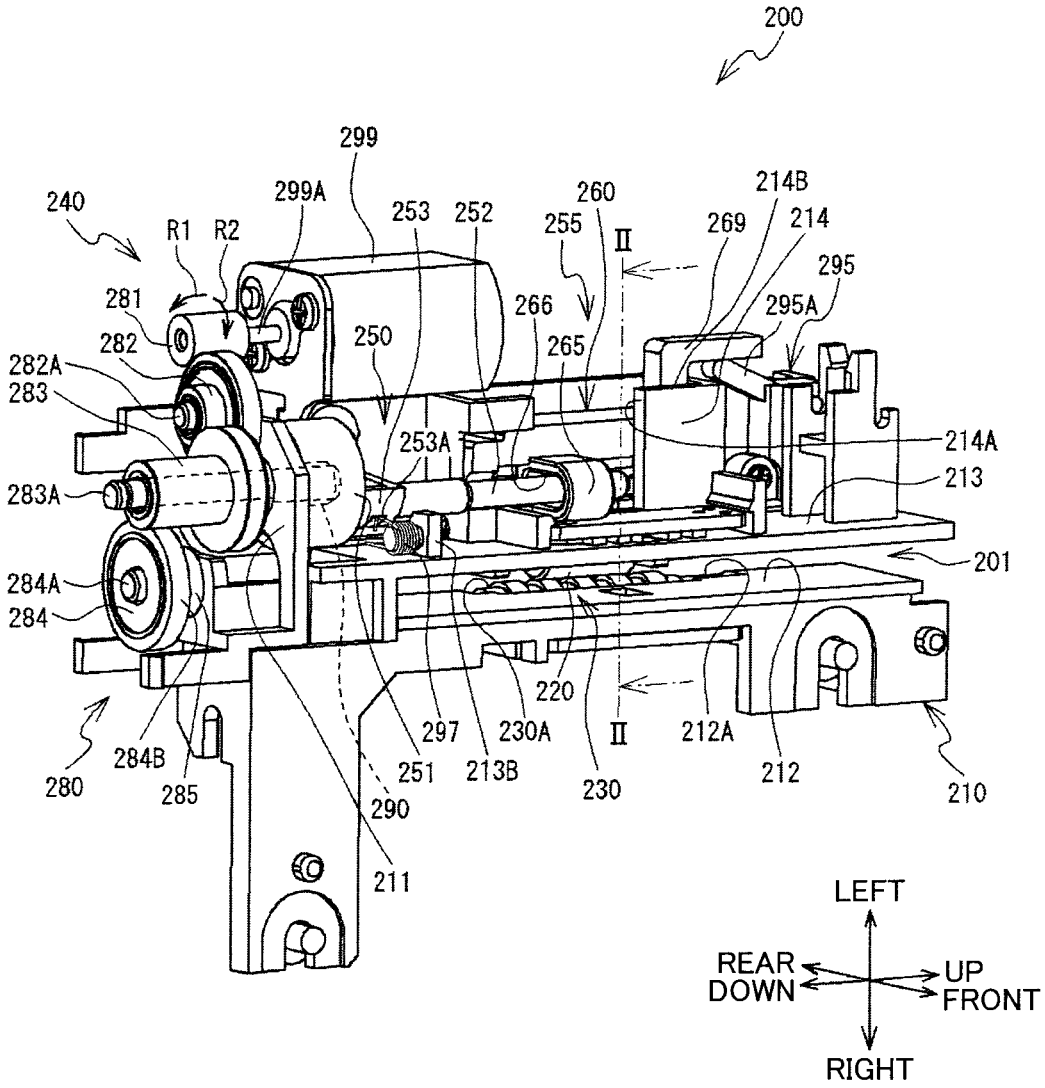
FIG. 3 is a perspective view of an output unit, with an output roller located at a nip position.
Figure 4:
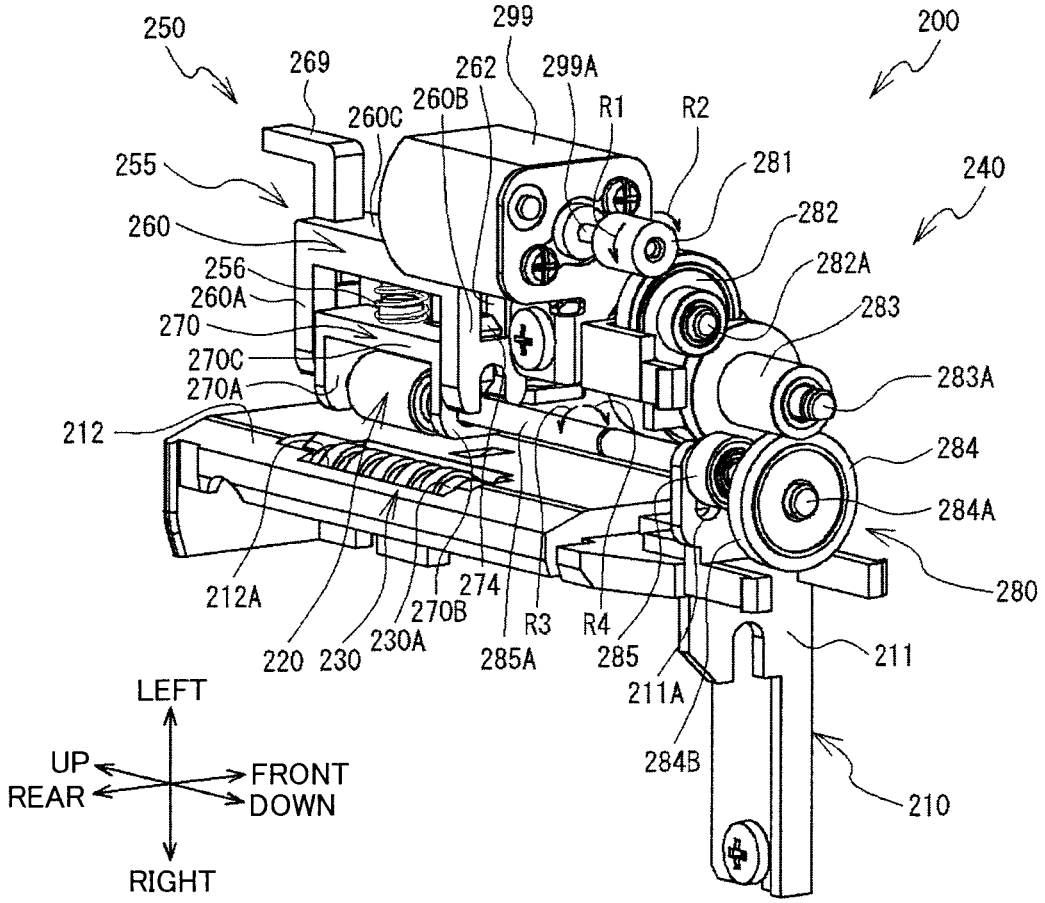
FIG. 4 is a perspective view of the output unit, with the output roller located at a release position.

There will be next described a configuration of the output unit 200 in detail with reference to FIGS. 3-7. FIG. 4 omits illustration of a third frame 213, a guide frame 214, and a position detecting sensor 295 of the output unit 200. As illustrated in FIG. 2, the output unit 200 is provided in the housing 2 at a position located at a rear of the output opening 11 and downstream of the cutting unit 100 in the conveying direction (i.e., in front of the cutting unit 100).

As illustrated in FIGS. 3 and 4, the output unit 200 includes a fixed frame 210, the output roller 220, the opposed roller 230, an output motor 299, a first coupling mechanism 280, a moving mechanism 250, a second coupling mechanism 240, and the position detecting sensor 295. The fixed frame 210 is fixed in the housing 2 at a position near a rear portion of the output opening 11 and includes a first frame 211, a second frame 212, and the third frame 213.

The first frame 211 is provided at a lower portion of the output unit 200 and extends in a direction orthogonal to the up and down direction. Each of the second frame 212 and the third frame 213 extends upward from the first frame 211 and extends in a direction orthogonal to the right and left direction. The third frame 213 is located to the left of the second frame 212 and opposed to the second frame 212 with a predetermined space therebetween. The space between the second frame 212 and the third frame 213 is a passage opening 201. The passage opening 201 is formed between the tape output opening 73 and the output opening 11 (see FIGS. 6 and 7). The printing medium 5 is conveyed forward from the upstream side toward the downstream side so as to pass through the tape output opening 73, the passage opening 201, and the output opening 11 in this order.

Figure 6:
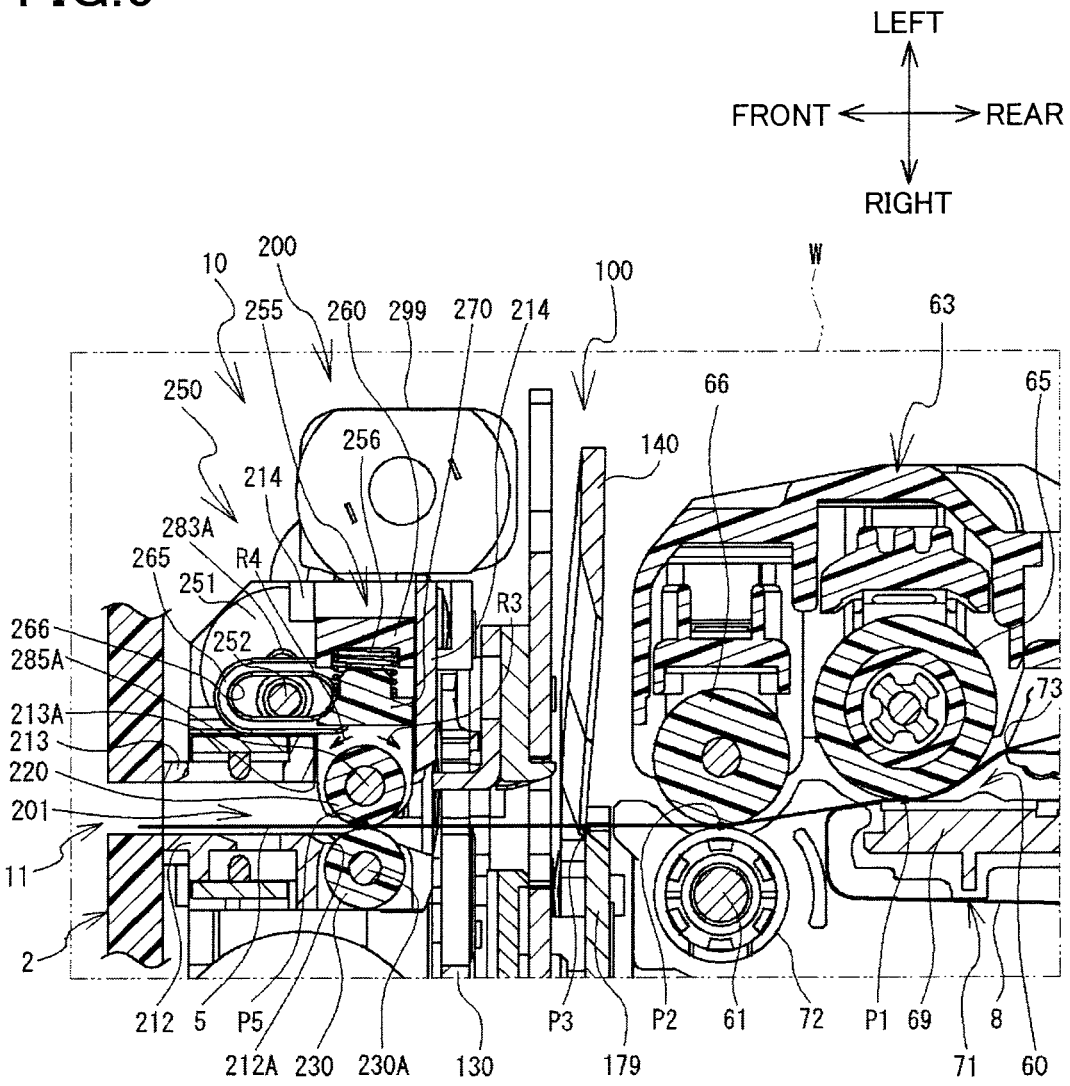
FIG. 6 is an enlarged view of a region W in FIG. 2 when the output roller is located at the nip position.
Figure 7:
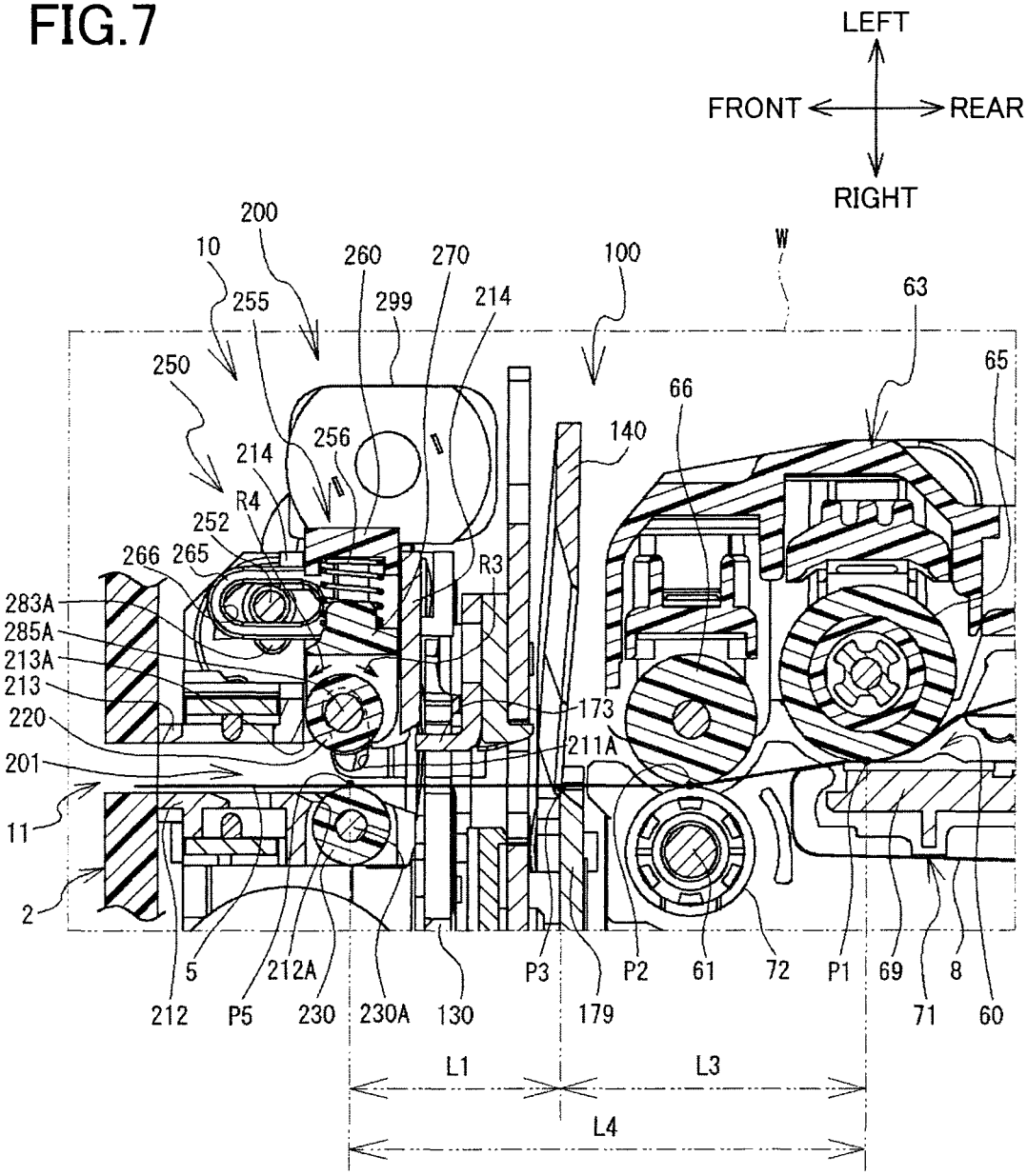
FIG. 7 is an enlarged view of the region W in FIG. 2 when the output roller is located at the release position.

The output roller 220 is provided to the left of the passage opening 201 (see FIGS. 6 and 7). The output roller 220 is a cylindrical elastic member extending in the up and down direction and disposed in a hole 213A (see FIGS. 6 and 7). The hole 213A is formed through a rear end portion of the third frame 213 in the right and left direction so as to extend in a rectangular shape elongated in the up and down direction in side view.

The opposed roller 230 is provided to the right of the passage opening 201 (see FIGS. 6 and 7). The opposed roller 230 is located to the right of and opposed to the output roller 220 with the passage opening 201 therebetween. The opposed roller 230 extends in the up and down direction and is disposed in a hole 212A. The opposed roller 230 includes a plurality of cylindrical elastic members spaced uniformly in the up and down direction. The hole 212A is formed through a rear end portion of the second frame 212 in the right and left direction so as to extend in a rectangular shape elongated in the up and down direction in side view. A left end portion of the opposed roller 230 is located to the left of a left surface of the second frame 212. A rotation shaft 230A is rotatably inserted in a central hole of the opposed roller 230. The rotation shaft 230A is a circular cylindrical member extending in the up and down direction. Opposite end portions of the rotation shaft 230A are secured to inner walls of upper and lower portions of the hole 212A.

The output motor 299 is a DC motor secured to a left end portion of the first frame 211. An output shaft 299A of the output motor 299 extends downward from the output motor 299. The output motor 299 is capable of rotating the output shaft 299A in any of the counterclockwise direction (indicated by arrow R1) and the clockwise direction (indicated by arrow R2) in bottom view. Hereinafter, an operation of the output motor 299 in which the output motor 299 is driven so as to be rotated to rotate the output shaft 299A in the counterclockwise direction in bottom view may be referred to as "forward rotation". An operation of the output motor 299 in which the output motor 299 is driven so as to be rotated to rotate the output shaft 299A in the clockwise direction in bottom view may be referred to as "reverse rotation".

The first coupling mechanism 280 is provided at the lower portion of the output unit 200 and power-transmittably couples the output motor 299 and the output roller 220 to each other. The first coupling mechanism 280 includes coupling gears 281-284, a moving gear 285, and a rotation shaft 285A. The rotation axis of each of the coupling gears 281-284 and the moving gear 285 extends in the up and down direction. The coupling gear 281 is a spur gear secured to a lower end portion of the output shaft 299A.

The coupling gear 282 is disposed on a front right side of the coupling gear 281. The coupling gear 282 is a double gear constituted by a large-diameter gear and a small-diameter gear. A rear left end portion of the large-diameter gear of the coupling gear 282 is engaged with a front right end portion of the coupling gear 281. A rotation shaft 282A is rotatably inserted in a central hole of the coupling gear 282. The rotation shaft 282A is a circular cylindrical member secured to the first frame 211 and extending downward from the first frame 211. The coupling gear 283 is disposed on a front right side of the coupling gear 282. The coupling gear 283 is a double gear constituted by a large-diameter gear and a small-diameter gear. A rear left end portion of the large-diameter gear of the coupling gear 283 is engaged with a front right end portion of the small-diameter gear of the coupling gear 282. A lower end portion of a rotation shaft 283A is inserted and secured in a central hole of the coupling gear 283. The rotation shaft 283A extends through the first frame 211 in the up and down direction. An upper end portion of the rotation shaft 283A is located above an upper surface of the first frame 211. The rotation shaft 283A is rotatably supported by the first frame 211. A portion of the rotation shaft 283A which is located above the first frame 211 has a circular cylindrical shape. A portion of the rotation shaft 283A which is located below the first frame 211 has a D-cut shape.

The coupling gear 284 is provided to the right of the coupling gear 283. The coupling gear 284 is a double gear constituted by a large-diameter gear and a small-diameter gear. A left end portion of the large-diameter gear of the coupling gear 284 is engaged with a right end portion of the small-diameter gear of the coupling gear 283. A rotation shaft 284A is rotatably inserted in a central hole of the coupling gear 284. The rotation shaft 284A is a circular cylindrical member secured to the first frame 211 and extending downward from the first frame 211. The moving gear 285 is a spur gear provided at a rear of the coupling gear 284. A front end portion of the moving gear 285 is engaged with a rear end portion of the small-diameter gear of the coupling gear 284. The rotation shaft 285A extends parallel with the rotation shaft 230A. A lower end portion of the rotation shaft 285A has a D-cut shape. The entire portion of the rotation shaft 285A which is different from its lower end portion has a circular cylindrical shape. The lower end portion of the rotation shaft 285A is located below the first frame 211 and inserted and secured in a central hole of the moving gear 285. The rotation shaft 285A extends upward to an upper end of the hole 213A and is inserted and secured in a central hole of the output roller 220.

The first frame 211 has a guide hole 211A. The guide hole 211A extends in the up and down direction through a portion of the first frame 211 which is located at a rear of the coupling gear 284. The guide hole 211A extends in an arc shape in plan view along an outer circumferential surface 284B of the coupling gear 284 on which teeth of the coupling gear 284 are provided (see FIG. 7). It is noted that a portion of the guide hole 211A which is hidden by, e.g., the output roller 220 is indicated by the broken line in FIG. 7. A portion of the rotation shaft 285A which is located above the moving gear 285 is inserted in the guide hole 211A. The rotation shaft 285A is movable in the guide hole 211A along the guide hole 211A.

The moving mechanism 250 moves the output roller 220 toward and away from the opposed roller 230. In the present embodiment, the moving mechanism 250 moves the output roller 220 between a position at which the output roller 220 is located to the left of the opposed roller 230 and close to or in contact with the opposed roller 230 as illustrated in FIGS. 3 and 6 (noted that this position will be hereinafter referred to as "nip position") and a position at which the output roller 220 is located to the left of and far from the opposed roller 230 as illustrated in FIGS. 4 and 7 (noted that this position will be hereinafter referred to as "release position").

The moving mechanism 250 includes a rotor 251, an eccentric member 252, and a roller holder 255. The rotor 251 is a cylindrical member disposed on an opposite side of the first frame 211 from the coupling gear 283. The upper end portion of the rotation shaft 283A is rotatably inserted in a central hole of the rotor 251. The eccentric member 252 is a circular cylindrical member extending upward from a position on the rotor 251 which is eccentric to the rotation shaft 283A. Thus, with rotation of the rotor 251, the eccentric member 252 is rotated about the rotation shaft 283A in plan view.

Figure 5:
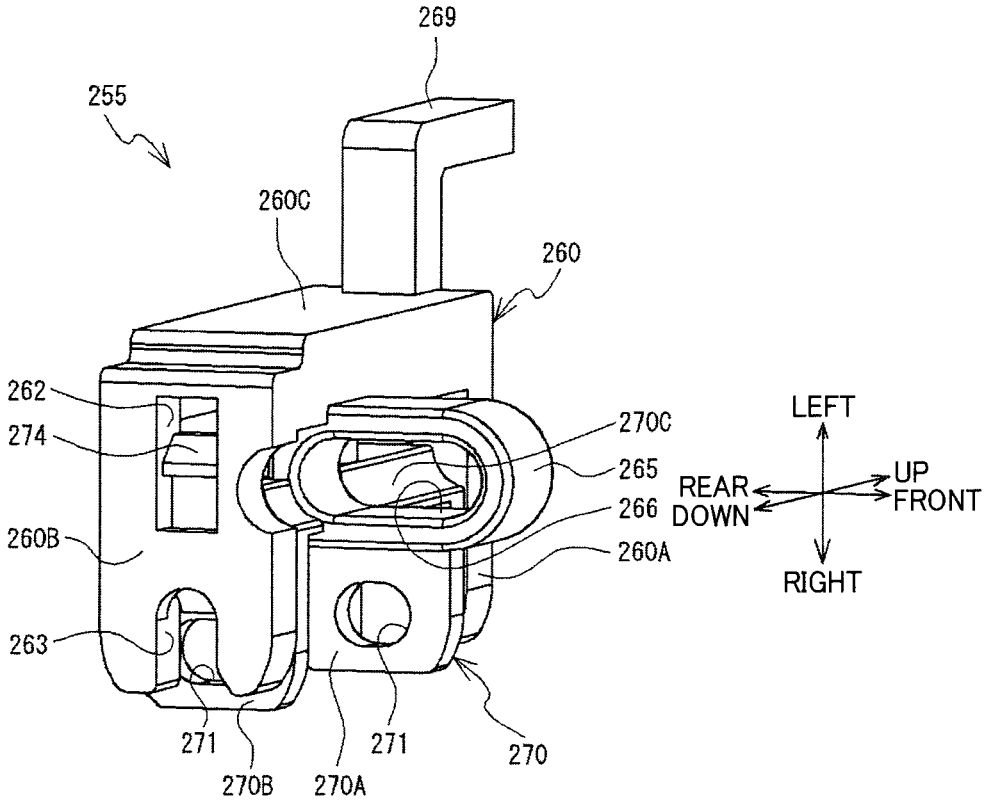
FIG. 5 is a perspective view of a roller holder viewed from a lower front left side thereof.

A larger-diameter portion 253 is provided at a lower end portion of the eccentric member 252. The larger-diameter portion 253 is a portion to which the eccentric member 252 and an upper surface of the rotor 251 are fixed. The larger-diameter portion 253 is greater in diameter than the eccentric member 252 and has a semicircular shape in plan view. The larger-diameter portion 253 has a recessed portion 253A (see FIG. 3). The recessed portion 253A is recessed from an arc portion of the larger-diameter portion 253 toward the rotation shaft 283A (i.e., toward the center of rotation of the eccentric member 252). An urging member 297 is engageable with the recessed portion 253A. The urging member 297 is a torsion spring secured to an urging-member fixed member 213B. The urging-member fixed member 213B is provided on an upper surface of the third frame 213 at a position located near an upper front portion of the rotor 251. Both ends of the urging member 297 extend rearward. When the larger-diameter portion 253 is located to the right of the rotation shaft 283A, the recessed portion 253A opens rightward, so that an end portion of the urging member 297 is engaged with the recessed portion 253A from a right side thereof (see FIG. 3). When the larger-diameter portion 253 is located to the left of the rotation shaft 283A, the recessed portion 253A opens leftward, so that the end portion of the urging member 297 is separated from the recessed portion 253A (not illustrated).

as illustrated in FIG. 5, the roller holder 255 includes a first member 260, a second member 270, and an urging member 256 (see FIG. 4). The first member 260 has a U-shape that opens rightward in front view. Engaging holes 262 are respectively formed in an upper wall portion 260A and a lower wall portion 260B of the first member 260. It is noted that FIG. 5 omits illustration of the engaging hole 262 formed in the wall portion 260A. Each of the engaging holes 262 extends in the up and down direction through a left end portion of a corresponding one of the wall portions 260A, 260B. Each of the engaging holes 262 has a rectangular shape elongated in the right and left direction in plan view. The wall portion 260B has a recessed portion 263. The recessed portion 263 is recessed leftward from a right end portion of the wall portion 260B.

A protrusion 265 and a detecting piece 269 are provided on a wall portion 260C as a left portion of the first member 260. The protrusion 265 protrudes frontward from a right end portion of a front surface of the wall portion 260C. The protrusion 265 has a first support hole 266. The first support hole 266 is formed through the protrusion 265 in the up and down direction and elongated in the front and rear direction. The eccentric member 252 (see FIG. 3) is inserted in the first support hole 266. The first support hole 266 supports the eccentric member 252 such that the eccentric member 252 is movable in the front and rear direction. The detecting piece 269 extends leftward from an upper end portion of a left surface of the wall portion 260C and then extends upward.

The second member 270 has a U-shape that opens rightward in front view. The second member 270 is smaller than the first member 260. The second member 270 is disposed on an inner side of a recessed portion of the first member 260. The output roller 220 (see FIG. 4) is disposed in a recessed portion of the second member 270, i.e., between an upper wall portion 270A and a lower wall portion 270B of the second member 270. A right end portion of the second member 270 serves as a right end portion of the roller holder 255. A right end portion of the output roller 220 is located to the right of the right end portion of the roller holder 255. Second support holes 271 are formed in the respective wall portions 270A, 270B. Each of the second support holes 271 extends in the up and down direction through a right end portion of a corresponding one of the wall portions 270A, 270B. Each of the second support holes 271 is elongated in the front and rear direction. The rotation shaft 285A is inserted in the second support holes 271. The second support holes 271 support the rotation shaft 285A such that the rotation shaft 285A is rotatable and movable in the front and rear direction.

Engaging pieces 274 are provided on the respective wall portions 270A, 270B. It is noted that FIG. 5 omits illustration of the engaging piece 274 provided on the wall portion 270A. The engaging pieces 274 are shaped like hooks protruding leftward from left end portions of the respective wall portions 270A, 270B and facing away from each other. The hooked portion of each of the engaging pieces 274 is engaged with a corresponding one of the engaging holes 262 so as to be movable in the right and left direction. With this configuration, the second member 270 is supported by the first member 260 so as to be movable in the right and left direction, i.e., a direction toward and away from the opposed roller 230.

As illustrated in FIG. 4, the urging member 256 is provided between a right surface of the wall portion 260C and a left surface of a left wall portion 270C of the second member 270. The urging member 256 is a compression coil spring that urges the second member 270 rightward toward the opposed roller 230 with respect to the first member 260. Thus, in the case where a leftward force does not act on the second member 270, the second member 270 is kept by an urging force of the urging member 256 to a position at which the hooked portion of each of the engaging pieces 274 is in contact with a right end portion of the corresponding one of the engaging holes 262.

As illustrated in FIGS. 3, 6, and 7, the roller holder 255 is disposed at a rear of a left surface of the third frame 213 and on an inner side of the guide frame 214. The guide frame 214 extends leftward from the third frame 213. When viewed from a left side, the guide frame 214 has a substantially rectangular shape extending along the shape of the roller holder 255. The guide frame 214 has openings 214A, 214B. The opening 214A opens frontward at a lower front corner portion of the guide frame 214. The protrusion 265 protrudes frontward from the opening 214A. The opening 214B opens leftward at a left end of the guide frame 214. The detecting piece 269 protrudes leftward from the opening 214B. The guide frame 214 guides the roller holder 255 linearly in the right and left direction.

As illustrated in FIGS. 3 and 4, the second coupling mechanism 240 is provided at the lower portion of the output unit 200 and configured to power-transmittably couple the output motor 299 and the moving mechanism 250 to each other. The second coupling mechanism 240 includes the coupling gears 281-283, the rotation shaft 283A, and a one-way clutch 290. That is, the coupling gears 281-283 power-transmittably couple the output motor 299 and the output roller 220 to each other and power-transmittably couple the output motor 299 and the moving mechanism 250 to each other.

The one-way clutch 290 is provided between an inner wall of the rotor 251 and the upper end portion of the rotation shaft 283A. In FIG. 3, the one-way clutch 290 and portions of the rotation shaft 283A which are located inside the coupling gear 283, the first frame 211, and the rotor 251 are indicated by the broken lines.

The one-way clutch 290 power-transmittably couples the output motor 299 and the rotor 251 to each other when the output motor 299 is rotated reversely. The one-way clutch 290 disengages power transmission between the output motor 299 and the rotor 251 (that is, the one-way clutch 290 decouples the output motor 299 and the rotor 251 from each other) when the output motor 299 is rotated forwardly. In the present embodiment, when the output motor 299 is rotated reversely (as indicated by arrow R2), the rotation shaft 283A is rotated via the coupling gears 281-283 in the clockwise direction in bottom view. When the rotation shaft 283A is rotated in the clockwise direction in bottom view, the one-way clutch 290 rotates the rotor 251 with the rotation shaft 283A. When the output motor 299 is rotated forwardly (as indicated by arrow R1), the rotation shaft 283A is rotated via the coupling gears 281-283 in the counterclockwise direction in bottom view. When the rotation shaft 283A is rotated in the counterclockwise direction in bottom view, the one-way clutch 290 idles the rotor 251 with respect to the rotation shaft 283A.

As illustrated in FIG. 3, the position detecting sensor 295 is secured to the left surface of the third frame 213 above the guide frame 214. The position detecting sensor 295 is a switch sensor and includes a movable piece 295A. The movable piece 295A is provided to the right of an upper end portion of the detecting piece 269. The movable piece 295A is always urged leftward and engaged at a predetermined engaging position. When the movable piece 295A pivots rightward to a predetermined movable position, the position detecting sensor 295 outputs a detection signal. The position detecting sensor 295 detects whether the output roller 220 is located at the nip position.

There will be next described, with reference to FIGS. 3 and 4, operations of components of the output unit 200 in the case where the output motor 299 is rotated forwardly. A driving force generated by the output motor 299 rotating forwardly (as indicated by arrow R1) is transmitted by the first coupling mechanism 280 from the output shaft 299A to the output roller 220 via the coupling gears 281, 282, 283, 284, the moving gear 285, and the rotation shaft 285A in this order. It is noted that the driving force generated by the output motor 299 rotating forwardly may be hereinafter referred to as "forward driving force generated by the output motor 299". Thus, when the output motor 299 is rotated forwardly, the output roller 220 is rotated in the counterclockwise direction in bottom view (indicated by arrow R3). This rotational direction of the output roller 220 may be hereinafter referred to as "discharging direction". When the printing medium 5 comes into contact with the output roller 220 rotating in the discharging direction, the printing medium 5 is conveyed forward.

The forward driving force generated by the output motor 299 is transmitted by the second coupling mechanism 240 from the output shaft 299A to the coupling gears 281, 282, 283 and the rotation shaft 283A in this order. In this case, the one-way clutch 290 disengages power transmission between the output motor 299 and the rotor 251, so that the forward driving force generated by the output motor 299 is not transmitted from the rotation shaft 283A to the rotor 251. Thus, the rotor 251 is not rotated even when the output motor 299 is rotated forwardly. Accordingly, the printer 1 can rotate the output motor 299 forwardly to rotate the output roller 220 in the discharging direction in a state in which the output roller 220 is kept at its position. That is, the printer 1 can rotate the output motor 299 forwardly to rotate the output roller 220 in the discharging direction without movement of the output roller 220 between the nip position (see FIGS. 3 and 6) and the release position (see FIGS. 4 and 7).

There will be next described, with reference to FIGS. 3, 4, 6, and 7, operations of the components of the output unit 200 in the case where the output motor 299 is rotated reversely. As illustrated in FIGS. 3 and 4, a driving force generated by the output motor 299 rotating reversely (as indicated by arrow R2) is transmitted by the first coupling mechanism 280 from the output shaft 299A to the output roller 220 via the coupling gears 281, 282, 283, 284, the moving gear 285, and the rotation shaft 285A in this order. It is noted that the driving force generated by the output motor 299 rotating reversely may be hereinafter referred to as "reverse driving force generated by the output motor 299". Thus, when the output motor 299 is rotated reversely, the output roller 220 is rotated in the clockwise direction in bottom view, i.e., a direction reverse to the discharging direction (as indicated by arrow R4). This rotational direction of the output roller 220 may be hereinafter referred to as "returning direction".

The reverse driving force generated by the output motor 299 is transmitted by the second coupling mechanism 240 from the output shaft 299A to the coupling gears 281, 282, 283 and the rotation shaft 283A in this order. In this case, the one-way clutch 290 power-transmittably couples the output motor 299 and the rotor 251 to each other, so that the reverse driving force generated by the output motor 299 is transmitted from the rotation shaft 283A to the rotor 251. Thus, when the output motor 299 is rotated reversely, the rotor 251 is rotated about the rotation shaft 283A in the clockwise direction in bottom view. In this case, the eccentric member 252 is rotated about the rotation shaft 283A in the clockwise direction in bottom view.

In this case, as illustrated in FIGS. 6 and 7, the eccentric member 252 presses the protrusion 265 leftward or rightward while moving in the first support hole 266 in the front and rear direction. This operation moves the roller holder 255 leftward or rightward in the guide frame 214 along the guide frame 214. With the leftward or rightward movement of the roller holder 255, inner walls of the respective second support holes 271 (see FIG. 5) or the recessed portion 263 (see FIG. 5) presses the rotation shaft 285A leftward or rightward. The leftward or rightward movement of the rotation shaft 285A moves the output roller 220 between the nip position and the release position. Accordingly, the printer 1 can rotate the output motor 299 reversely to cause the moving mechanism 250 to move the output roller 220 between the nip position (see FIG. 6) and the release position (see FIG. 7).

In the case where the output roller 220 is moved between the nip position and the release position, the rotation shaft 285A is moved along the guide hole 211A while moving in the front and rear direction in the second support holes 271 (see FIG. 5). That is, the rotation shaft 285A is moved along the outer circumferential surface 284B of the coupling gear 284. Thus, when the output roller 220 is moved from the release position to the nip position, the output roller 220 approaches the opposed roller 230 diagonally from a slightly front and left side of the opposed roller 230 (see FIG. 7). The moving gear 285 is moved together with the rotation shaft 285A along the outer circumferential surface 284B of the coupling gear 284. Accordingly, the moving gear 285 is moved in a state in which the moving gear 285 is engaged with the coupling gear 284. Thus, the output roller 220 is moved between the nip position and the release position in a state in which the output motor 299 and the output roller 220 are kept power-transmittably coupled to each other by the first coupling mechanism 280. That is, even when the output roller 220 is located any of the nip position and the release position, the output motor 299 and the output roller 220 are power-transmittably coupled to each other by the first coupling mechanism 280.

When the output roller 220 is located at the nip position, the printing medium 5 is nipped between the output roller 220 and the opposed roller 230. In the case where the printing medium 5 is not located between the output roller 220 and the opposed roller 230, the output roller 220 is in contact with the opposed roller 230. It is noted that the output roller 220 may be opposed to the opposed roller 230 at a distance less than the thickness of the printing medium 5. When the output roller 220 is located at the release position, the output roller 220 is located to the left of and separated from the printing medium 5. Hereinafter, a position in the conveying direction at which the printing medium 5 is nipped between the output roller 220 and the opposed roller 230 may be referred to as "second nipping position P5". A load at which the printing medium 5 is nipped between the output roller 220 and the opposed roller 230 may be referred to as "nip load at the second nipping position P5".

As illustrated in FIG. 7, when the eccentric member 252 is located to the left of the rotation shaft 283A, the eccentric member 252 is located at a left end of a moving area of the eccentric member 252 in the right and left direction. In this case, the roller holder 255 is located at a left end of a moving area of the roller holder 255 in the right and left direction, and the output roller 220 is located at the release position. When the eccentric member 252 is rotated in this state about the rotation shaft 283A in the counterclockwise direction in plan view, the eccentric member 252 presses the protrusion 265 rightward while moving rearward in the first support hole 266. In this case, the first member 260, the second member 270, and the output roller 220 are moved rightward together until the output roller 220 is located at the nip position, i.e., until the output roller 220 is located at the position at which the printing medium 5 is nipped between the output roller 220 and the opposed roller 230.

In the present embodiment, as illustrated in FIG. 6, before the eccentric member 252 reaches a right end of the moving area of the eccentric member 252 in the right and left direction, the output roller 220 is positioned at the position at which the printing medium 5 is nipped between the output roller 220 and the opposed roller 230, i.e., the nip position. After the output roller 220 is positioned at the nip position, when the eccentric member 252 is moved to the right end of the moving area of the eccentric member 252 in the right and left direction, the first member 260 is moved rightward. In this case, rightward movement of the second member 270 and the output roller 220 is inhibited by the opposed roller 230. That is, the first member 260 approaches the second member 270 and the output roller 220 against the urging force of the urging member 256. Accordingly, in the case where the eccentric member 252 is moved between the left end and the right end of the moving area of the eccentric member 252 in the right and left direction, an amount of movement of the first member 260 in the right and left direction is greater than an amount of movement of the output roller 220 and the second member 270 in the right and left direction.

In the case where the first member 260 is moved toward the second member 270 and the output roller 220 against the urging force of the urging member 256, the urging force of the urging member 256 for urging the output roller 220 toward the opposed roller 230 increases. This configuration enables the printer 1 to adjust the nip load at the second nipping position P5 in accordance with the position of the eccentric member 252 in the right and left direction. When the output roller 220 is located at the nip position, the distance from the opposed roller 230 to the first member 260 is determined by the thickness of the printing medium 5. Increase in the thickness of the printing medium 5 decreases the distance from the second member 270 to the first member 260 and accordingly increases the urging force of the urging member 256. This configuration enables the printer 1 to change the nip load at the second nipping position P5 in accordance with the thickness of the printing medium 5.

As illustrated in FIG. 3, when the output roller 220 is located at the nip position, the larger-diameter portion 253 is located to the right of the rotation shaft 283A. Thus, the urging member 297 is engaged with the recessed portion 253A. In this case, the urging member 297 urges the larger-diameter portion 253 diagonally to a front left side thereof. That is, the urging member 297 urges the rotor 251 in the counterclockwise direction in bottom view. When the rotor 251 is rotated in the clockwise direction in bottom view, the urging member 297 restricts the output roller 220 from moving from the nip position to the release position. The urging force of the urging member 297 is less than a force required to rotate the rotor 251 in the counterclockwise direction in bottom view. Thus, the output roller 220 is kept at the nip position by the urging force of the urging member 297.

When the output roller 220 is located at the release position, the detecting piece 269 is located to the left of and separated from the movable piece 295A (not illustrated). The detecting piece 269 presses the movable piece 295A rightward in a process in which the output roller 220 is moved from the release position to the nip position. When the output roller 220 is moved to the nip position, the movable piece 295A pivots to the movable position while being pressed rightward by the detecting piece 269. In the present embodiment, when the eccentric member 252 is positioned at the right end of the moving area of the eccentric member 252 in the right and left direction, the detecting piece 269 is located at a right end of a moving area of the detecting piece 269 in the right and left direction. In this case, the movable piece 295A is located at the movable position. This configuration enables the position detecting sensor 295 to detect whether the output roller 220 is located at the nip position by detecting whether the detecting piece 269 (i.e., the first member 260) is located at the right end of the moving area of the detecting piece 269 in the right and left direction.

There will be next described an electric configuration of the printer 1 with reference to FIG. 8. The printer 1 includes a CPU 81. The CPU 81 serves as a processor configured to control the printer 1 and execute a main process which will be described below. Devices connected to the CPU 81 include a flash memory 82, a ROM 83, a RAM 84, the thermal head 60, the conveying motor 68, the cutting motor 105, the output motor 299, the input interface 4, the position detecting sensor 295, and a takeout detecting sensor 32. The flash memory 82 is a nonvolatile storage medium that stores programs for the CPU 81 to execute the main process, for example. The ROM 83 is a nonvolatile storage medium that stores various parameters required for the CPU 81 to execute various programs. The RAM 84 is a volatile storage medium that stores temporal data such as data relating to a timer and a counter.

The CPU 81 controls drivings of the thermal head 60, the conveying motor 68, the cutting motor 105, and the output motor 299. The input interface 4 outputs information intput by a user, to the CPU 81. The position detecting sensor 295 outputs a detection signal to the CPU 81. The takeout detecting sensor 32 is provided downstream of the nipping position P5, for example. The takeout detecting sensor 32 is a photo sensor of a transmission type and detects whether the printing medium 5 is present at a position located downstream of the full-cut position P3 in the conveying direction. Specifically, in the case where the printing medium 5 is present at a position located downstream of the full-cut position P3, the takeout detecting sensor 32 outputs an ON signal. In the case where the printing medium 5 is absent at a position located downstream of the full-cut position P3, the takeout detecting sensor 32 outputs an OFF signal.

There will be next described the main process with reference to FIGS. 9-23. After establishing the printing prepared state of the printer 1, the user turns on a power source of the printer 1. When the power source of the printer 1 is turned on, the CPU 81 starts the main process by transferring the program stored in the flash memory 82 to the RAM 84. At the start of the main process, a leading end portion of the printing medium 5 is located in the output opening 11.

At the start of the main process, the printer 1 is in its initial state. In the case where the printer 1 is in the initial state, each of the cutting unit 100 and the output unit 200 is in its initial state. In the case where the cutting unit 100 is in the initial state, the full-cut blade 140 is located at the distant position. In the case where the output unit 200 is in the initial state, the output roller 220 is located at the release position. At the start of the main process, the leading end portion of the printing medium 5 is located on a front side of the nipping position P5 (see FIG. 10).

Figure 9:
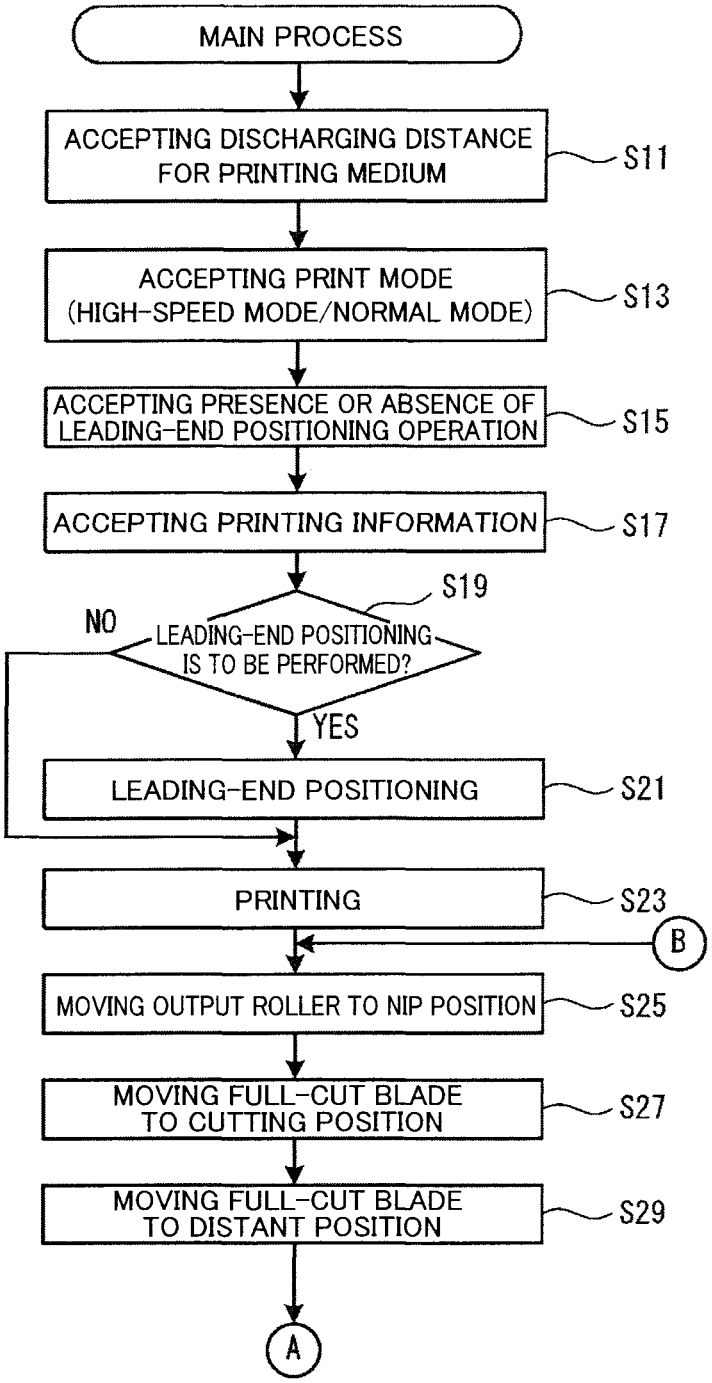
FIG. 9 is a flowchart representing a portion of a main process.

As illustrated in FIG. 9, the main process begins with S11 at which the CPU 81 accepts a discharging distance for the printing medium 5. The discharging distance for the printing medium 5 is a distance by which the printing medium 5 fully cut and located downstream of the full-cut position P3 (i.e., the leading printing medium 5A which will be described below) is to be conveyed forward by the output unit 200. For example, the user operates the input interface 4 to input a distance less than the first distance and greater than zero, as the discharging distance. As a result, the CPU 81 obtains the discharging distance set selectively. It is noted that the user may input zero to the input interface 4 as the discharging distance.

The CPU 81 at S13 accepts information indicating a print mode. In the present embodiment, the print mode includes a high-speed mode and a normal mode. A length of time required for successive printing on the printing medium 5 in the high-speed mode is less than a length of time required for successive printing on the printing medium 5 in the normal mode. The user, for example, operates the input interface 4 to input information indicating the normal mode as a desired print mode, whereby the CPU 81 accepts the information indicating the normal mode.

The CPU 81 at S15 accepts the presence or absence of the leading-end positioning operation. In this example, the user is allowed to operate the input interface 4 to input information indicating whether the leading-end positioning operation is to be performed. For example, when the user operates the input interface 4 to input information indicating that the leading-end positioning operation is not to be performed, the CPU 81 accepts that the leading-end positioning operation is not to be performed. In this example, when the CPU 81 at S13 accepts information indicating the high-speed mode, the CPU 81 cannot accept information indicating that the leading-end positioning operation is to be performed, regardless of input of the user, and accepts only the information indicating that the leading-end positioning operation is not to be performed.

The CPU 81 at S17 accepts the printing information. For example, the CPU 81 receives the printing information transmitted from the external terminal. The CPU 81 at S19 determines whether the CPU 81 at S15 has accepted the information indicating that the leading-end positioning operation is to be performed. In this example, the CPU 81 at S15 has not accepted the information indicating that the leading-end positioning operation is to be performed (S19: NO). Thus, the CPU 81 at S23 controls the conveying motor 68 and the thermal head 60 to perform printing on the printing medium 5. For example, the CPU 81 rotates the conveying motor 68 in the forward-conveyance direction. The platen roller 65, the conveying roller 66, and the driving roller 72 are rotated to convey the printing medium 5 forward. During this conveyance, the thermal head 60 prints characters represented by the printing information accepted at S17, on the printing medium 5 being conveyed forward. In this example, the leading end portion of the printing medium 5 is discharged from the output opening 11 to a front side thereof (see FIG. 11).

The CPU 81 at S25 controls the output motor 299 to move the output roller 220 to the nip position. Specifically, the CPU 81 rotates the output motor 299 reversely to move the output roller 220 to the nip position. The printing medium 5 on which the characters are printed is nipped between the output roller 220 and the opposed roller 230 (see FIG. 11).

The CPU 81 at S27 controls the cutting motor 105 to move the full-cut blade 140 from the distant position to the cutting position. As a result, the printing medium 5 on which the characters are printed is fully cut (see FIG. 12). Hereinafter, a portion of the printing medium 5 which is located downstream of the full-cut position P3 after execution of the processing at S27 will be referred to as "leading printing medium 5A", and a portion of the printing medium 5 which is located upstream of the full-cut position P3 after execution of the processing at S27 will be referred to as "succeeding printing medium 5B".

The CPU 81 at S29 controls the cutting motor 105 to move the full-cut blade 140 from the cutting position to the distant position. The full-cut blade 140 is moved leftward away from the fixed blade 179 (see FIG. 14).

Figure 12:
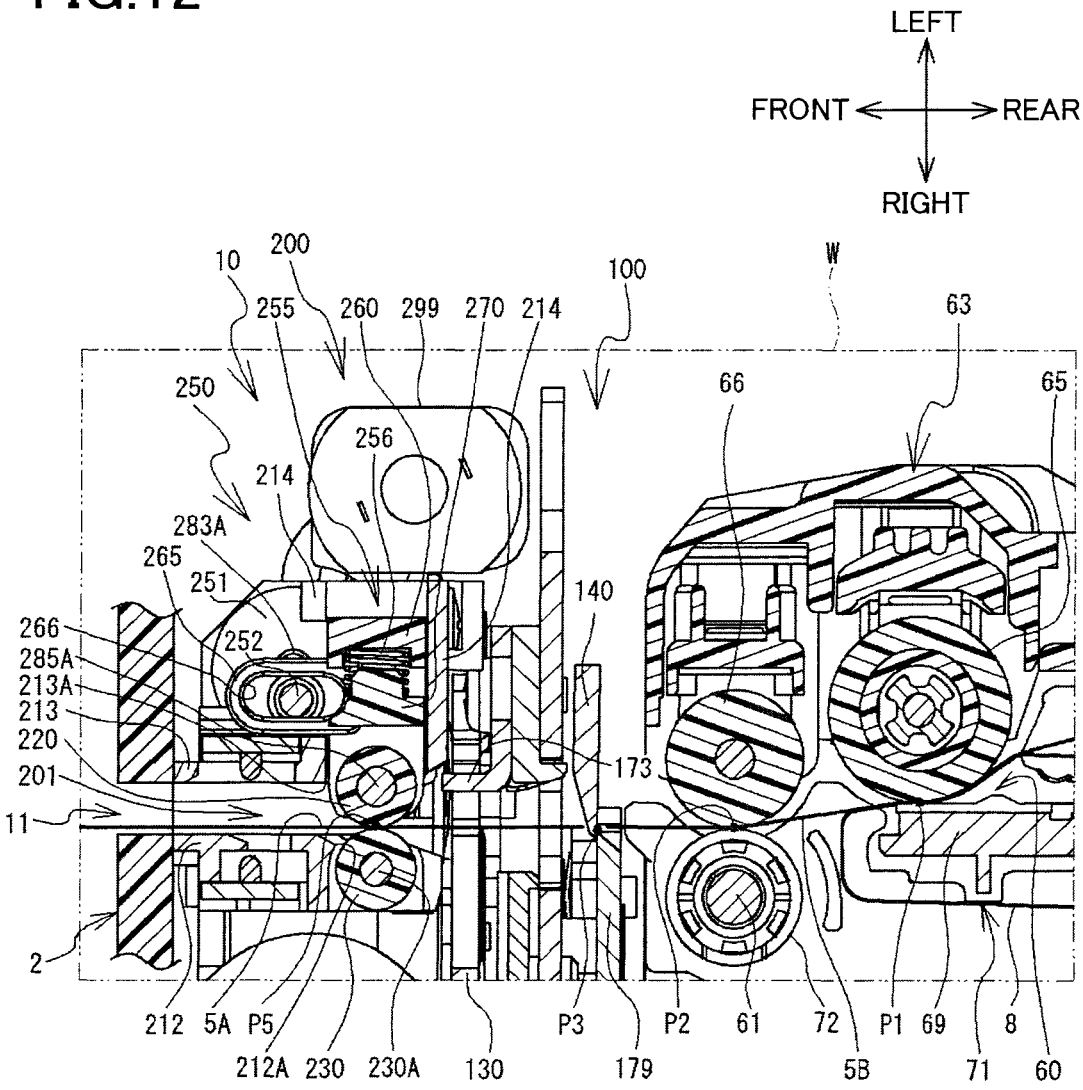
FIG. 12 is a cross-sectional view of the printing medium having been fully cut.
Figure 13:
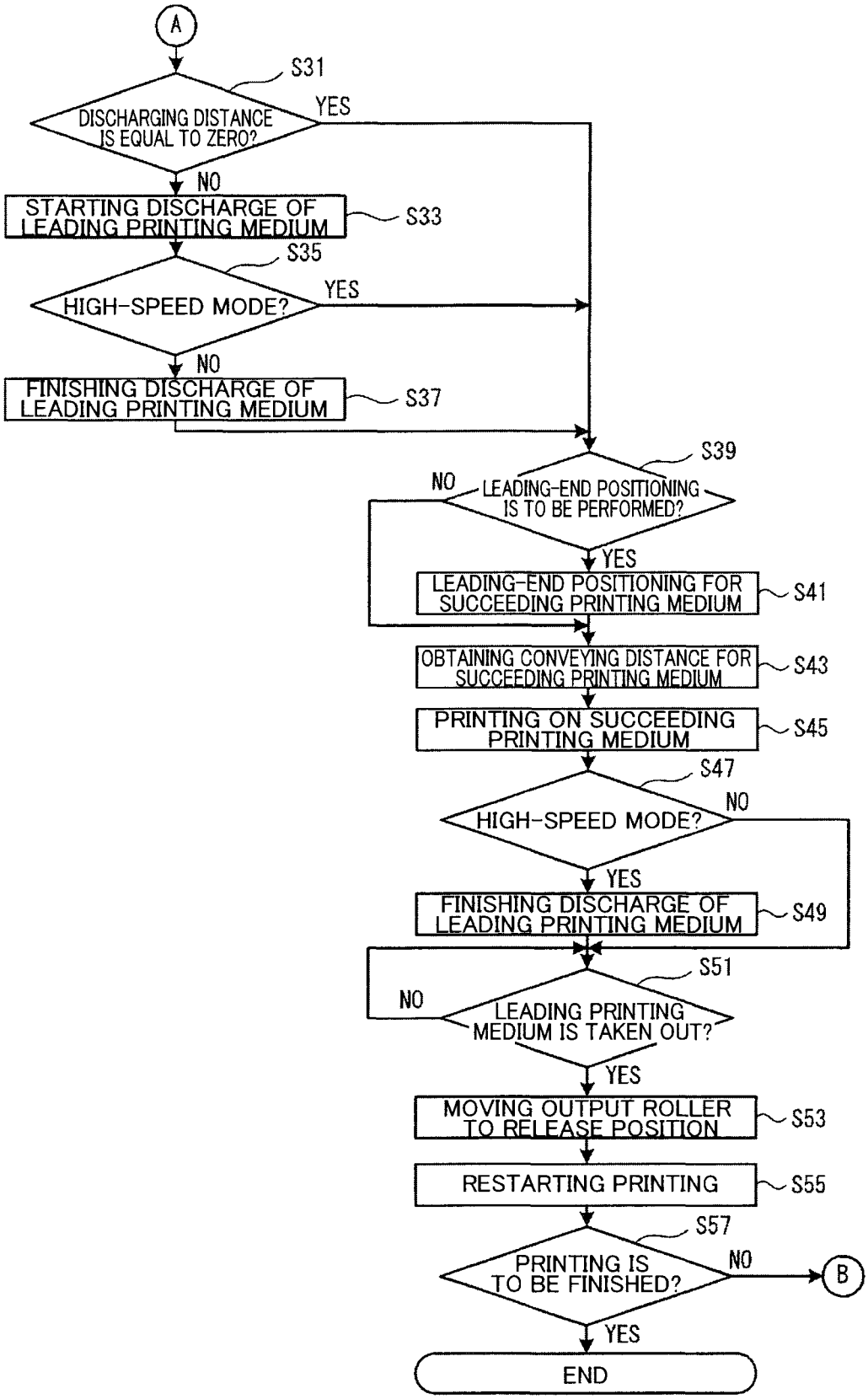
FIG. 13 is a flowchart representing the other portion of the main process which is continued from its portion in FIG. 9.

As illustrated in FIG. 12, the CPU 81 at S31 determines whether the discharging distance accepted at S11 is equal to zero. When the user at S11 inputs the discharging distance greater than zero (S31: NO), the CPU 81 at S33 controls the output motor 299 to start discharging the leading printing medium 5A. The output motor 299 is rotated forwardly to start rotating the output roller 220 in the discharging direction. The rotation of the output roller 220 in the discharging direction conveys the leading printing medium 5A forward. Thus, the trailing end portion of the leading printing medium 5A moves frontward away from the full-cut position P3 (see FIG. 14).

The CPU 81 at S35 determines whether the information indicating the high-speed mode is accepted at S13. When the information indicating the normal mode is accepted at S13 (S35: NO), the CPU 81 at S37 controls the output motor 299 to finish discharging the leading printing medium 5A. For example, the CPU 81 inputs a drive signal corresponding to the discharging distance accepted at S11, to the output motor 299 and then stops the forward rotation of the output motor 299. Since the discharging distance accepted at S11 is less than the first distance, the trailing end portion of the leading printing medium 5A is stopped at a position in the conveying direction at which the trailing end portion does not come out from between the output roller 220 and the opposed roller 230 (see FIG. 14).

The CPU 81 at S39 determines whether the CPU 81 at S15 has accepted the information indicating that the leading-end positioning operation is to be performed. When the CPU 81 at S15 has not accepted the information indicating that the leading-end positioning operation is to be performed (S39: NO), the CPU 81 at S43 obtains a conveying distance by which the succeeding printing medium 5B is to be conveyed downstream. In this example, the CPU 81 obtains the conveying distance based on the discharging distance accepted at S11, information indicating the print mode indicated by the information accepted at S13, and information about whether the leading-end positioning operation is performed at S41 which will be described below. For example, in the case where the information indicating the normal mode is accepted at S13, the conveying distance obtained at S43 is less than the second distance (that is, the conveying distance obtained at S43 is less than the first distance), for example. This conveying distance is calculated based on the discharging distance accepted at S11. That is, the CPU 81 calculates such a conveying distance that the leading end portion of the succeeding printing medium 5B does not contact the trailing end portion of the leading printing medium 5A. It is noted that the conveying distance obtained in the case where the information indicating the high-speed mode is accepted at S13 will be described below.

The CPU 81 at S45 controls the conveying motor 68 and the thermal head 60 to perform printing on the succeeding printing medium 5B while conveying the succeeding printing medium 5B forward. After the succeeding printing medium 5B is conveyed forward by the conveying distance obtained at S43, the CPU 81 stops the conveying motor 68 and the thermal head 60. Since this conveying distance is less than the second distance, the leading end portion of the succeeding printing medium 5B conveyed forward is located on a rear side of the trailing end portion of the leading printing medium 5A (see FIG. 15). It is noted that the speed at which the succeeding printing medium 5B is conveyed forward at S45 is less than the speed at which the leading printing medium 5A is conveyed forward in the processings at S33 and S37. In this example, no characters are not printed on a downstream portion of the succeeding printing medium 5B, and characters are printed on an upstream portion of the succeeding printing medium 5B.

The CPU 81 at S47 determines whether the information accepted at S13 indicates the high-speed mode. Since the information indicating the normal mode is accepted at S13 (S47: NO), the CPU 81 at S51 determines whether the leading printing medium 5A is taken out, based on the result of detection of the takeout detecting sensor 32. While the takeout detecting sensor 32 outputs the ON signal (S51: NO), the CPU 81 waits. When the user has taken out the leading printing medium 5A, the signal output from the takeout detecting sensor 32 is switched from the ON signal to the OFF signal (S51: YES).

Figure 10:
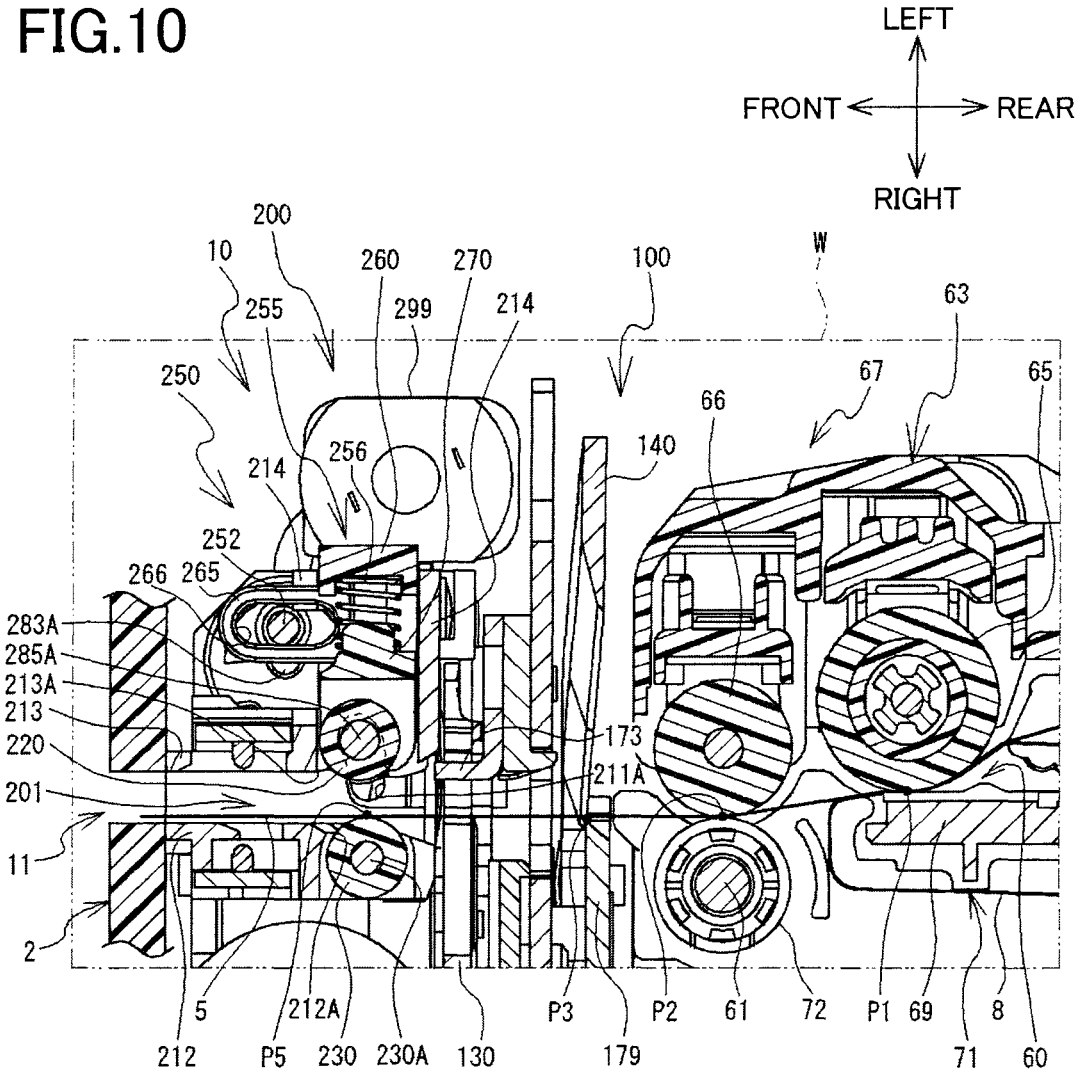
FIG. 10 is a cross-sectional view of a printing medium at a timing before the start of the main process.
Figure 11:
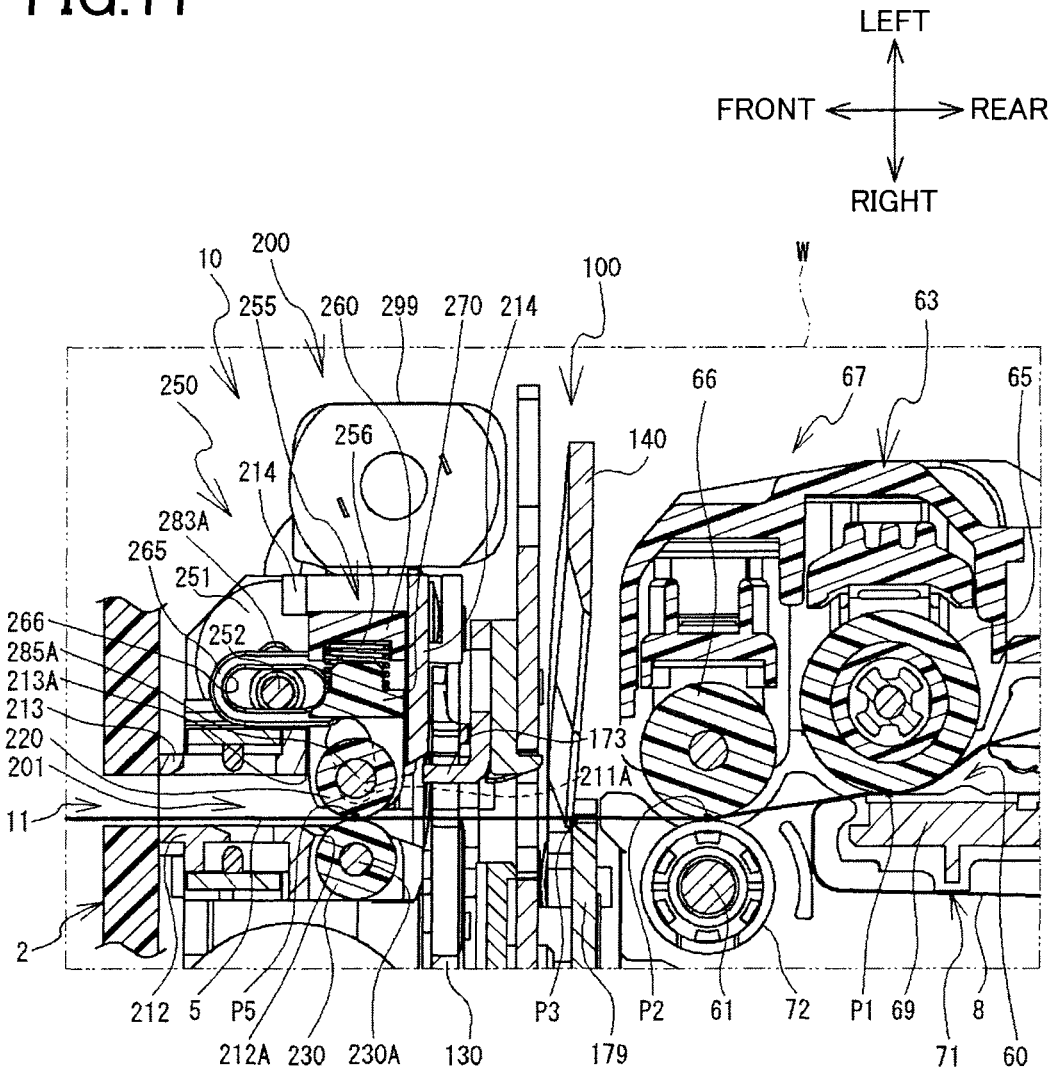
FIG. 11 is a cross-sectional view of the printing medium conveyed forward without leading-end positioning operation.

The CPU 81 at S53 controls the output motor 299 to move the output roller 220 to the release position. The output roller 220 is moved leftward away from the opposed roller 230 (see FIG. 16). The CPU 81 at S55 restarts printing on the succeeding printing medium 5B. That is, the CPU 81 controls the conveying motor 68 and the thermal head 60 to perform printing on the succeeding printing medium 5B while conveying the succeeding printing medium 5B forward. While the CPU 81 at S45 stops the conveying motor 68 and the thermal head 60 after the succeeding printing medium 5B is conveyed forward by the conveying distance obtained at S43, the CPU 81 at S55 performs remaining printing on the succeeding printing medium 5B to complete printing on the succeeding printing medium 5B. As a result, as illustrated in FIG. 10, the position of the leading end of the succeeding printing medium 5B is located downstream of the nipping position P5 in the conveying direction.

The CPU 81 at S57 determines whether the printing operation is to be finished. For example, in the case where printing has not been performed for a predetermined number of the printing media 5, the CPU 81 determines that the printing operation is not to be finished (S57: NO), and this flow returns to S25. Thereafter, as a result of the processing at S27, the succeeding printing medium 5B located on a front side of the full-cut position P3 becomes a new leading printing medium 5A, and the succeeding printing medium 5B located on a rear side of the full-cut position P3 becomes a new succeeding printing medium 5B. When printing has been performed for the predetermined number of the printing media 5, the CPU 81 determines whether the printing operation is to be finished (S57: YES), and the main process ends.

It is noted that the user may at S11 operate the input interface 4 to input zero as the discharging distance in the main process. In this case, after executing the processings at S13-S29, the CPU 81 determines that the discharging distance accepted at S11 is equal to zero (S31: YES). The CPU 81 executes the processings at S39 and S41. The conveying distance obtained at S43 may be less than the first distance and greater than the second distance. In this case, after printing on the succeeding printing medium 5B (S45), the leading end portion of the succeeding printing medium 5B overlaps the trailing end portion of the leading printing medium 5A in the right and left direction (see FIG. 17). Even in the case where zero is accepted as the discharging distance at S11, the state in which the output motor 299 is stopped is kept at S31. That is, the leading printing medium 5A is kept nipped between the output roller 220 and the opposed roller 230 at S31.

There will be next described the main process in the case where the information indicating the high-speed mode is accepted, with reference to FIGS. 9, 10, 12, 14, and 18. It is noted that an explanation of the same processings as executed in the above-described main process is simplified or omitted. The printer 1 at the start of the main process is in the printing prepared state, and the printing medium 5 is positioned in a state illustrated in FIG. 10.

The CPU 81 accepts the distance less than the first distance and greater than zero, as the discharging distance. The CPU 81 at S13 accepts the information indicating the high-speed mode and at S15 accepts the information indicating that the leading-end positioning operation is not to be performed. The CPU 81 executes the processings at S19-S27. At S27, the leading printing medium 5A and the succeeding printing medium 5B are created (see FIG. 12). After executing the processings at S29 and S31, the CPU 81 at S33 controls the output motor 299 to start discharging the leading printing medium 5A. The leading printing medium 5A is conveyed forward by the output unit 200 (as indicated by arrow D1 in FIG. 18).

Since the information indicating the high-speed mode is accepted at S13 (S35: YES), this flow goes to S39. Since the information indicating that the leading-end positioning operation is not to be performed is accepted at S15 (S39:

NO), the CPU 81 obtains the conveying distance for the succeeding printing medium 5B. When the information indicating the high-speed mode is accepted (S13), the CPU 81 at S43 obtains a distance less than the second distance, as the conveying distance. This conveying distance is calculated based on the conveying distance accepted at S11. The CPU 81 at S45 performs printing on the succeeding printing medium 5B. The succeeding printing medium 5B is conveyed forward (as indicated by arrow D2 in FIG. 18). The speed at which the succeeding printing medium 5B is conveyed forward is less than the speed at which the leading printing medium 5A is conveyed forward. Thus, the succeeding printing medium 5B does not contact the leading printing medium 5A being conveyed forward, even during forward conveyance of the leading printing medium 5A.

Figure 14:
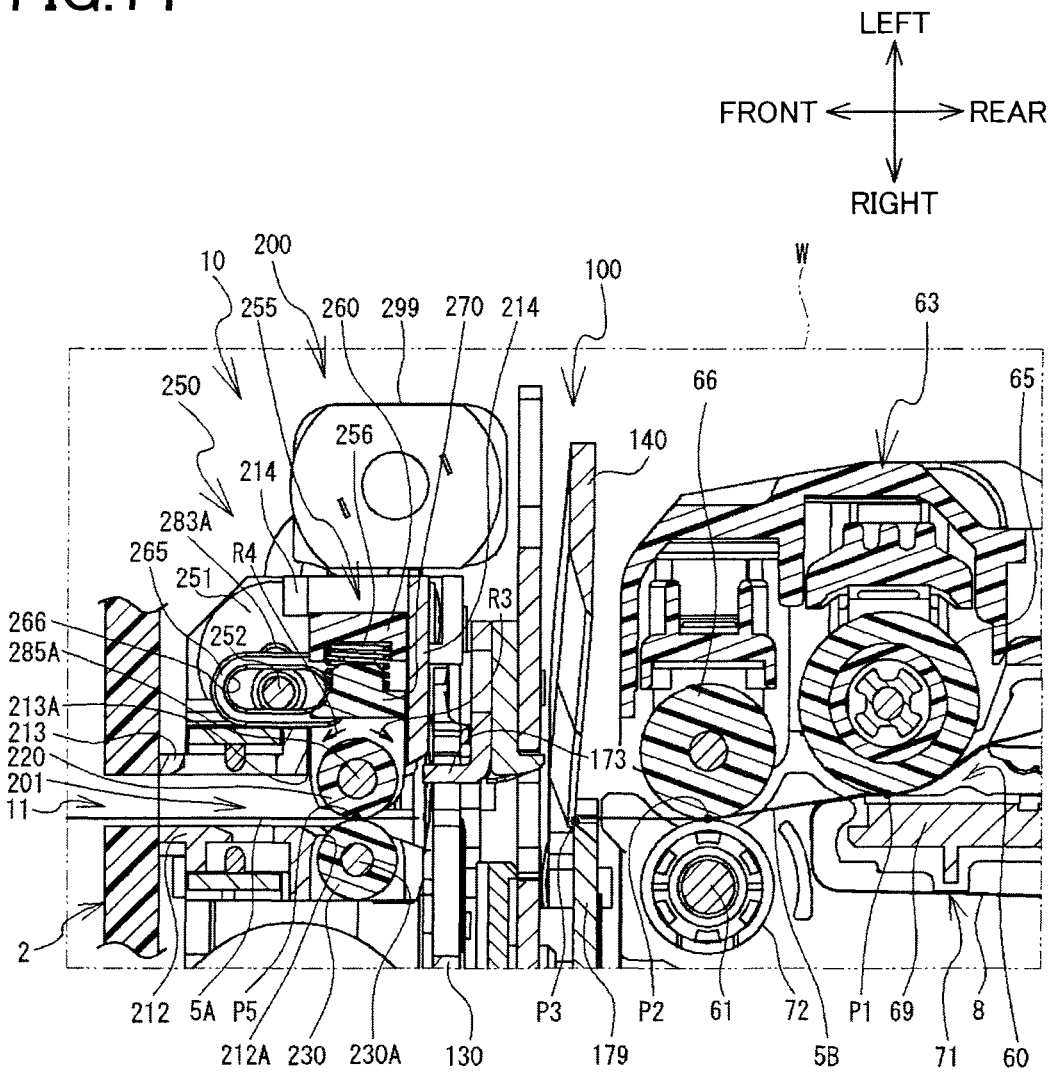
FIG. 14 is a cross-sectional view of a leading printing medium being conveyed forward.
Figure 15:
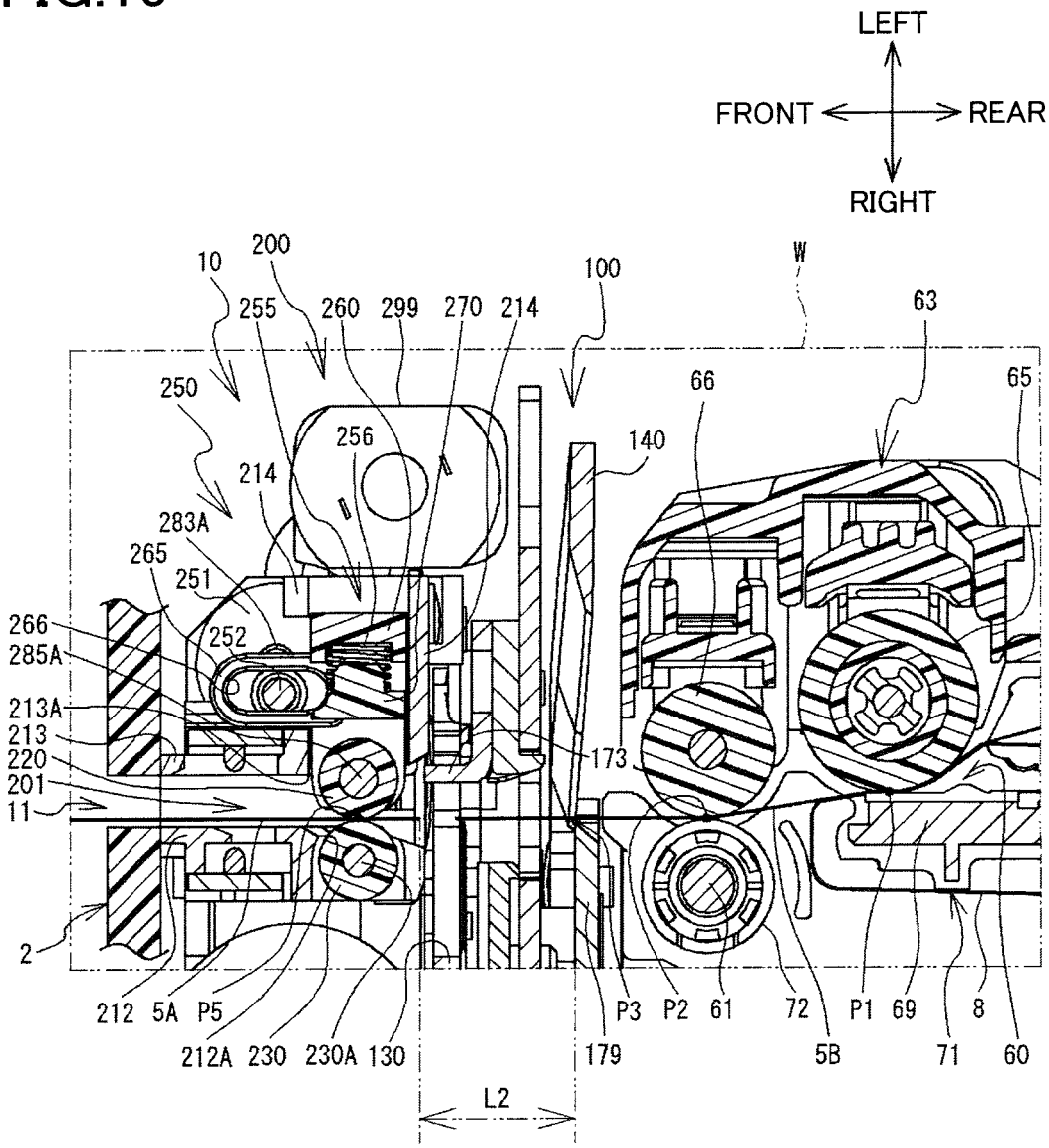
FIG. 15 is a cross-sectional view of a succeeding printing medium being conveyed forward.
Figure 16:
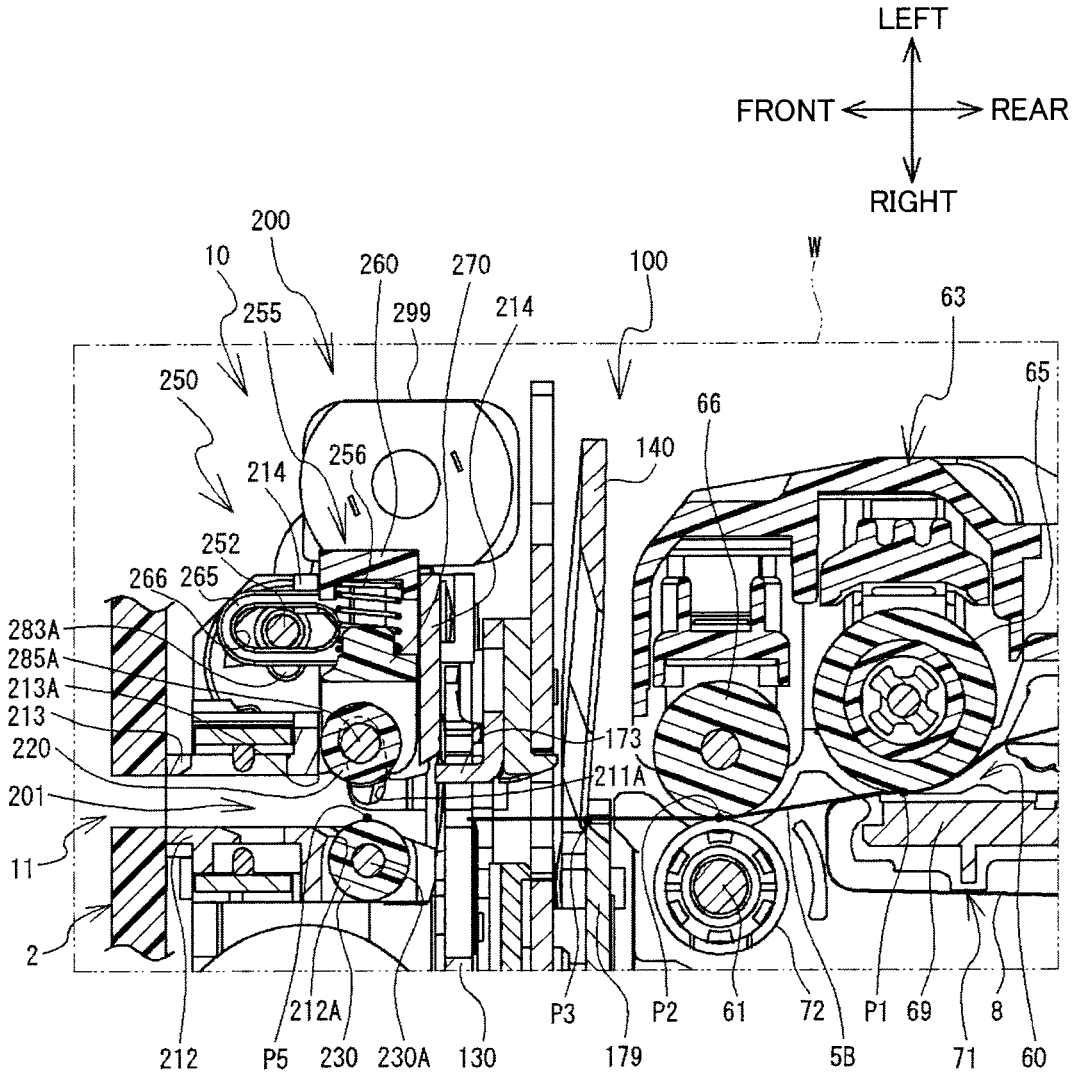
FIG. 16 is a cross-sectional view of the succeeding printing medium at a timing after the leading printing medium is taken out.
Figure 17:
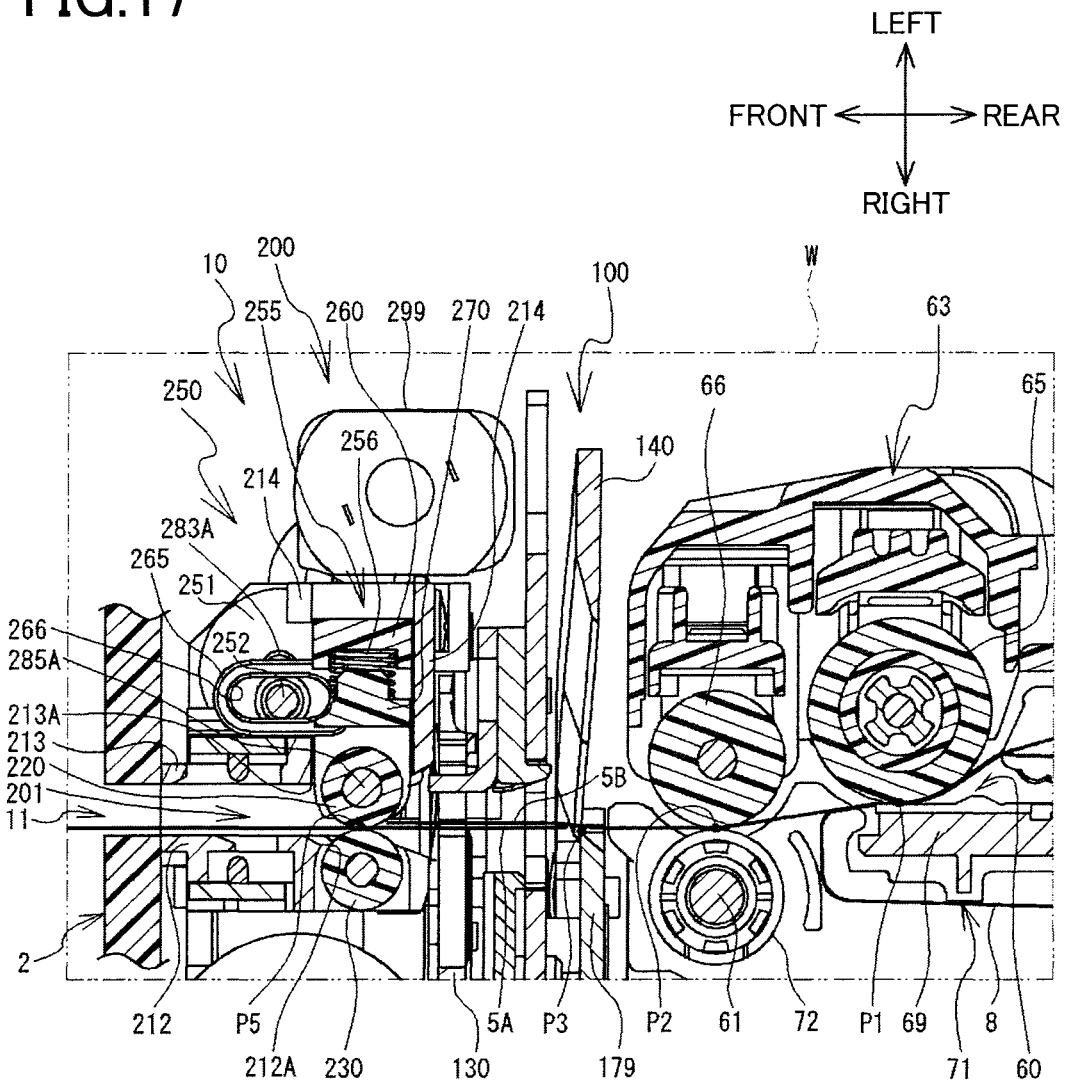
FIG. 17 is a cross-sectional view illustrating a state in which a leading end portion of the succeeding printing medium overlaps a trailing end portion of the leading printing medium in the right and left direction.
Figure 18:
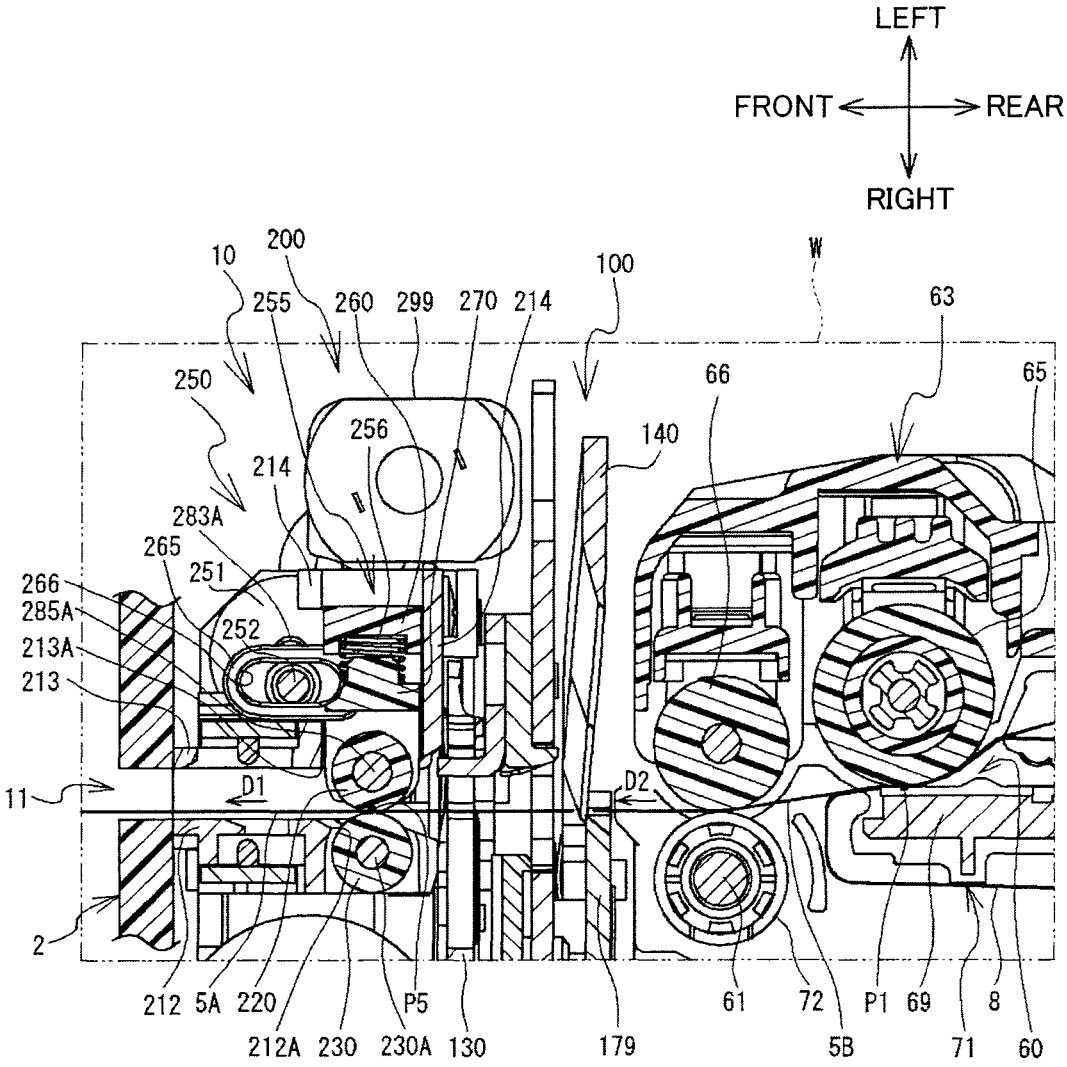
FIG. 18 is another cross-sectional view of the leading printing medium being conveyed.
Figure 19:
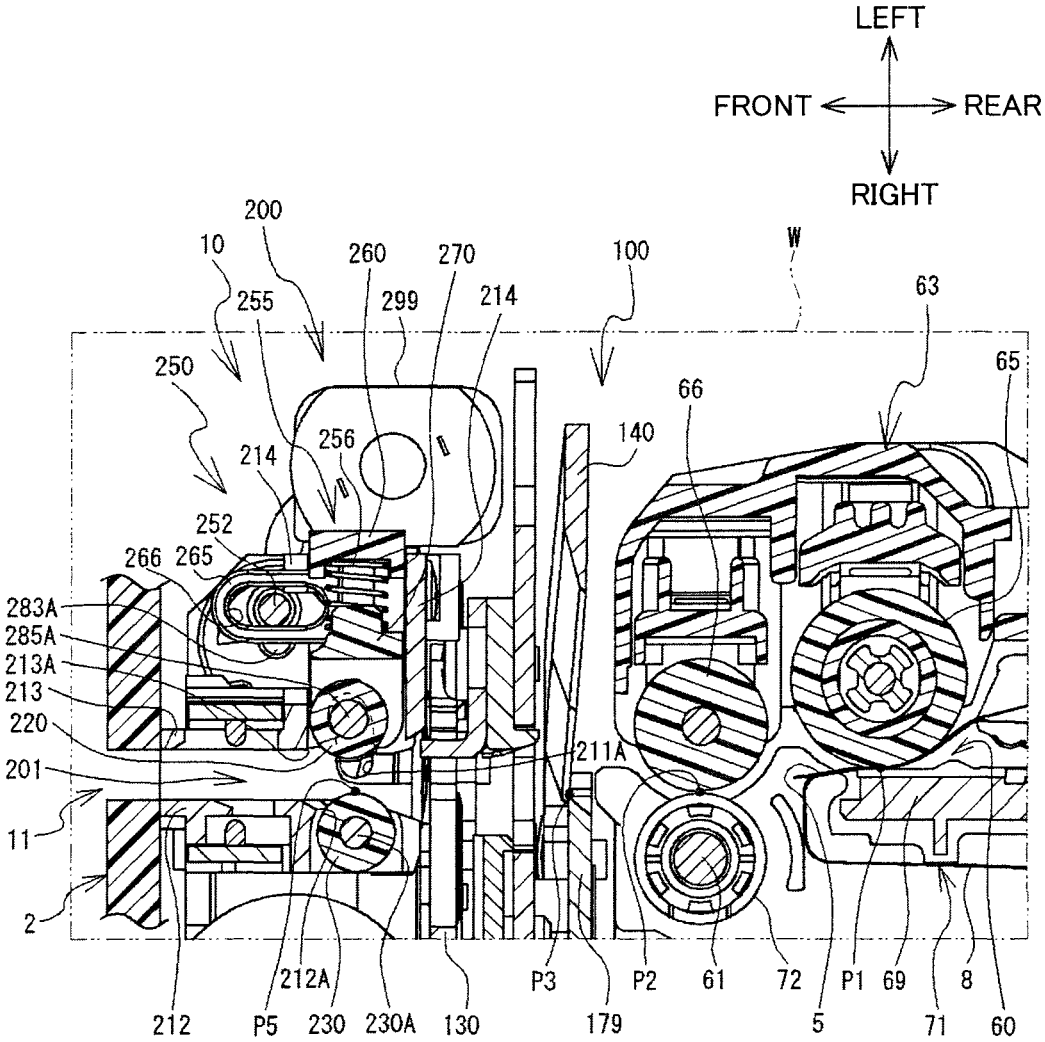
FIG. 19 is a cross-sectional view of the printing medium at a timing after a leading-end positioning operation is performed.

Since the information indicating the high-speed mode is accepted at S13 (S47: YES), the CPU 81 at S49 controls the output motor 299 to finish discharging the leading printing medium 5A after the end of printing on the succeeding printing medium 5B. FIG. 14, for example, illustrates the positional relationship between the leading printing medium 5A and the succeeding printing medium 5B after execution of the processing at S49. The CPU 81 executes the processings at S51-S57.

Figure 20:
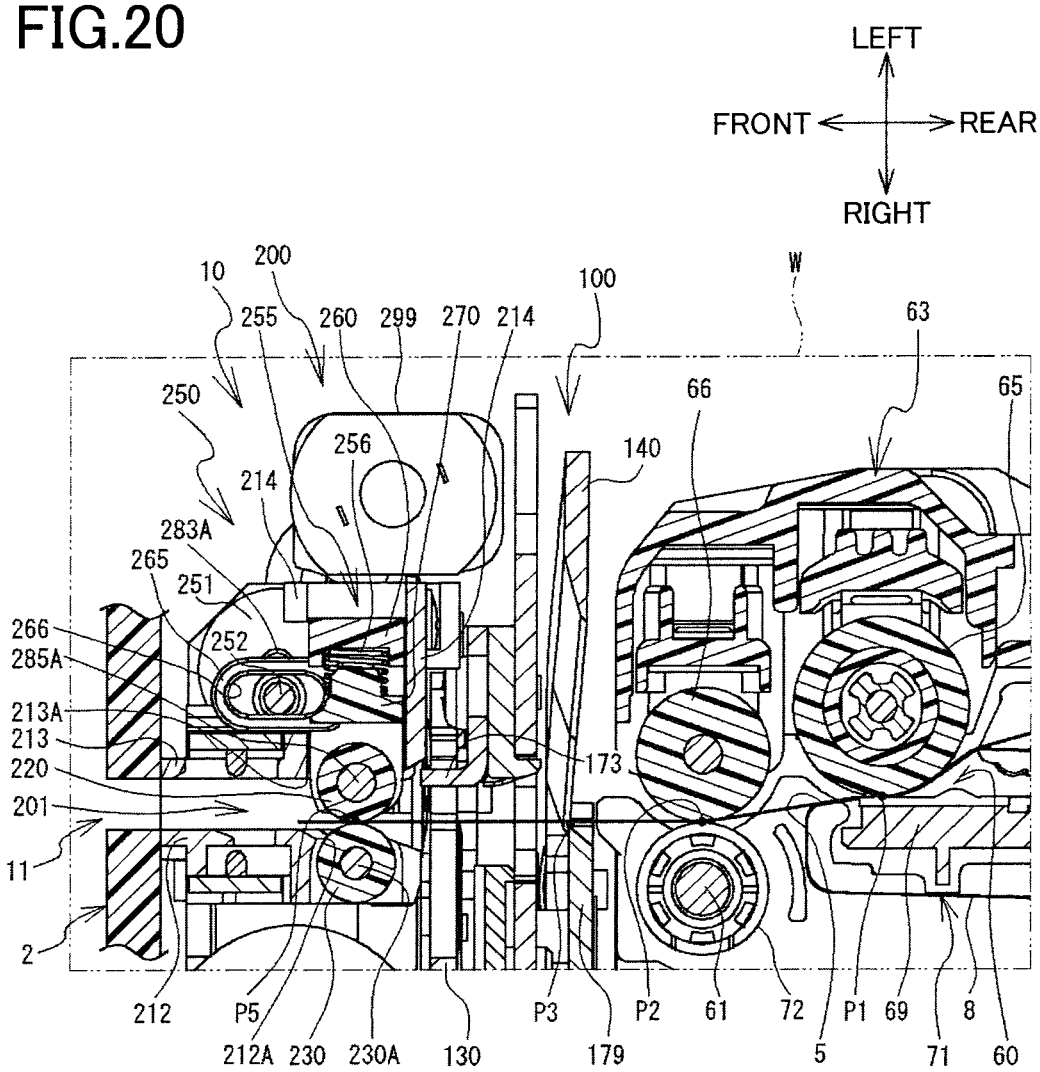
FIG. 20 is a cross-sectional view of the printing medium printed after the leading-end positioning operation is performed.
Figure 21:
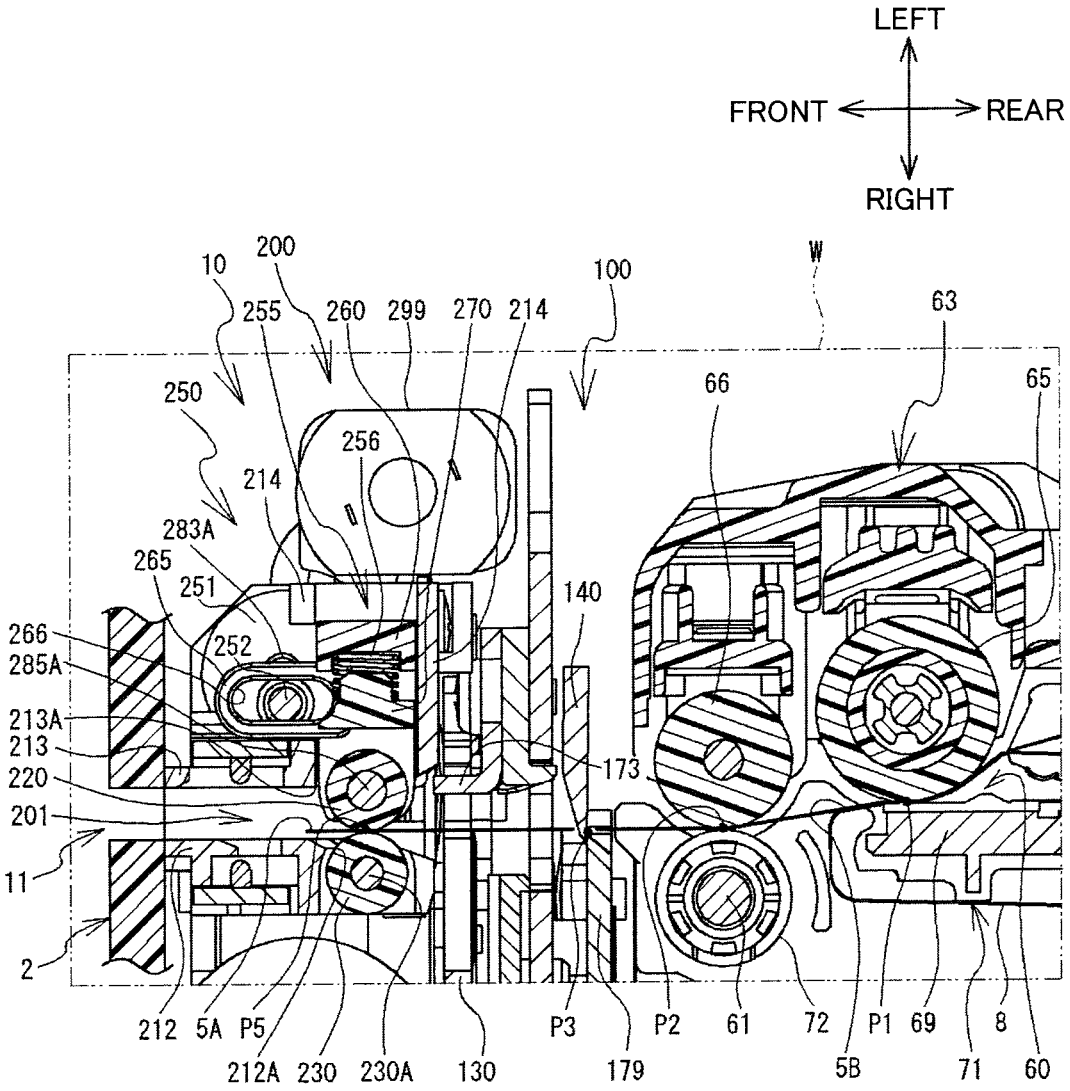
FIG. 21 is another cross-sectional view of the printing medium having been fully cut.
Figure 22:
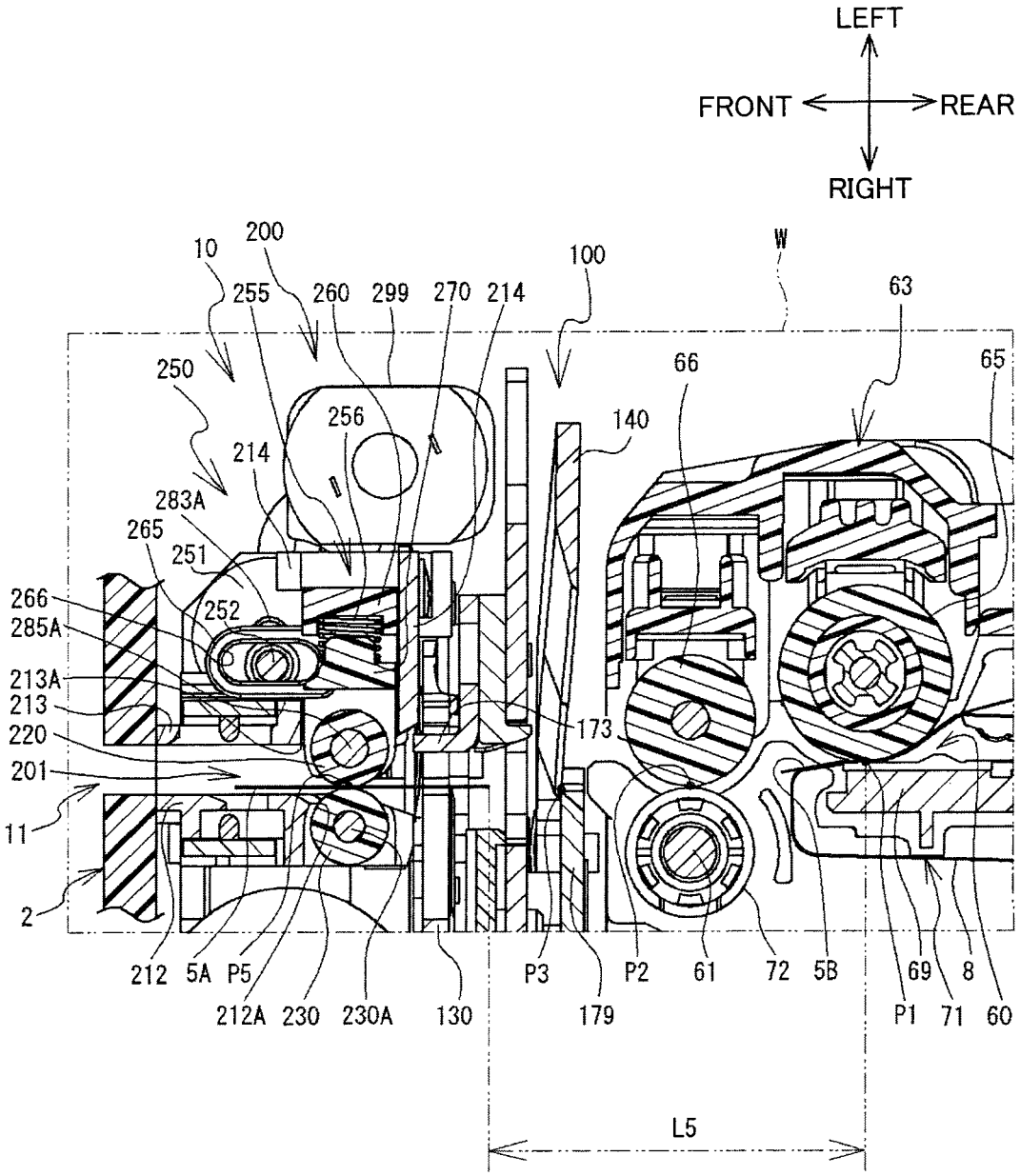
FIG. 22 is a cross-sectional view of the succeeding printing medium for which the leading-end positioning operation is performed.
Figure 23:
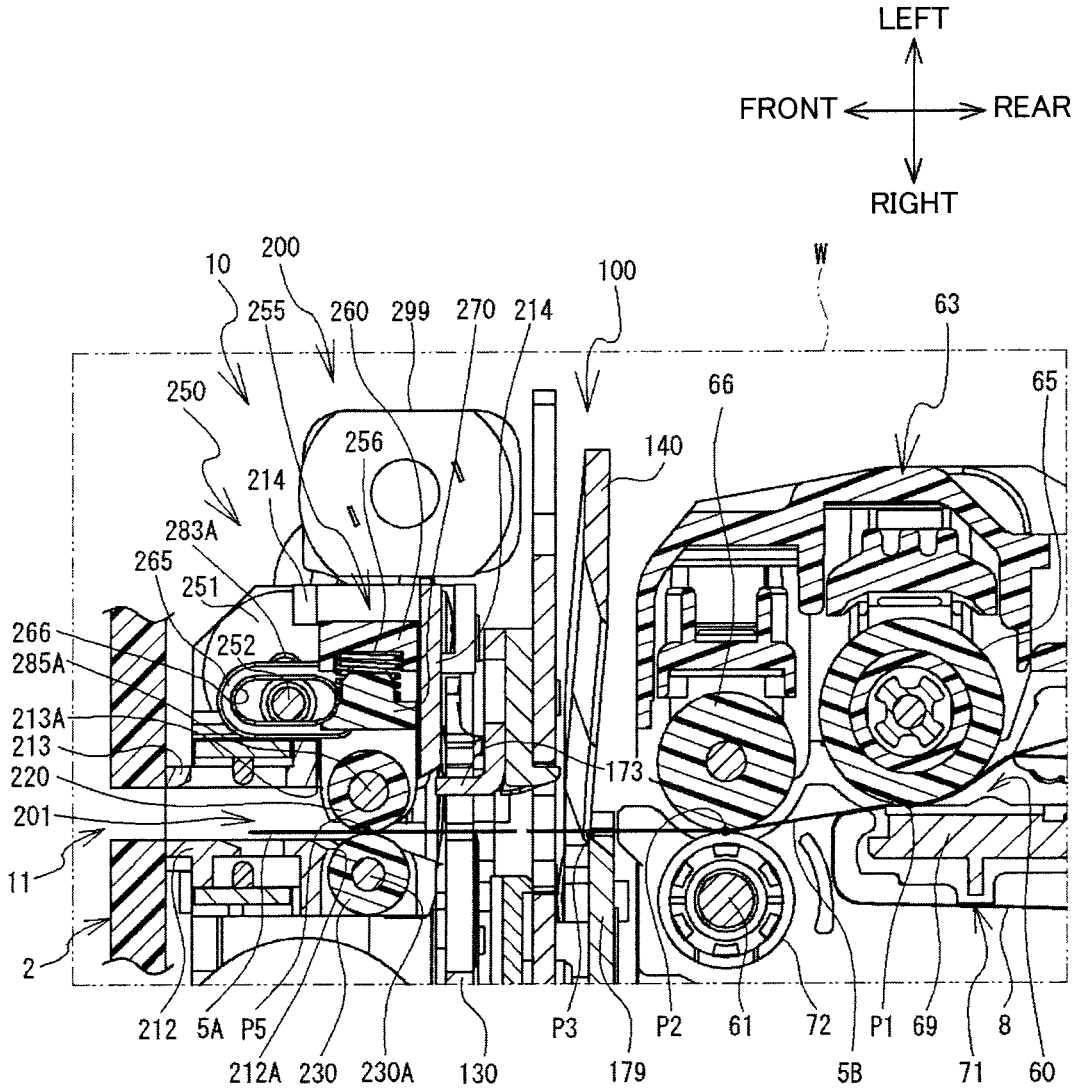
FIG. 23 is a cross-sectional view of the succeeding printing medium printed after the leading-end positioning operation is performed.

There will be next described the main process in the case where the information indicating that the leading-end positioning operation is to be performed is accepted, with reference to FIGS. 10, 20, and 23. It is noted that an explanation of the same processings as executed in the above-described main process is simplified or omitted. At the start of the main process, the printer 1 is in the printing prepared state, and the printing medium 5 is positioned in a state illustrated in FIG. 10.

The CPU 81 at S11 accepts a distance less than the first distance and greater than zero, as the discharging distance. The CPU 81 at S13 accepts the information indicating the normal mode and at S15 accepts the information indicating that the leading-end positioning operation is to be performed. The CPU 81 determines that the information indicating that the leading-end positioning operation is to be performed is accepted (S19: YES), and at S21 performs the leading-end positioning operation for the printing medium 5. The CPU 81 rotates the conveying motor 68 in the backward-conveyance direction while obtaining the result of detection of the takeout detecting sensor 32. The platen roller 65, the conveying roller 66, and the driving roller 72 are rotated to convey the printing medium 5 backward. After the signal output by the takeout detecting sensor 32 is switched from the ON signal to the OFF signal, the CPU 81 drives the output motor 299 by a predetermined driving amount. The CPU 81 then stops driving of the output motor 299. In this example, the leading end portion of the printing medium 5 is positioned between the roller nipping position P2 and the printing position P1 (see FIG. 19).

The CPU 81 at S23 performs printing on the printing medium 5. The CPU 81 drives the conveying motor 68 by a predetermined amount to convey the printing medium 5 forward by a predetermined conveying distance. The CPU 81 then stops driving of the conveying motor 68. The distance by which the printing medium 5 is conveyed forward at S23 is different between the case where the leading-end positioning operation is performed and the case where the leading-end positioning operation is not performed. In this example, the leading end portion of the printing medium 5 having been printed is positioned on a front side of the nipping position P5 at S23 (see FIG. 20). The CPU 81 at S25 controls the output motor 299 to move the output motor 299 to the nip position. The printing medium 5 having been printed is nipped between the output roller 220 and the opposed roller 230 (see FIG. 20).

The CPU 81 at S27 drives the cutting motor 105 to move the full-cut blade 140 to the cutting position. The full-cut blade 140 fully cuts the printing medium 5 (see FIG. 21). The CPU 81 at S29 drives the cutting motor 105 to move the full-cut blade 140 to the distant position. Since the discharging distance accepted at S11 is greater than zero (S31: NO), the CPU 81 at S33 controls the output motor 299 to start discharging the leading printing medium 5A. Since the information indicating the normal mode is accepted as the print mode (S35: NO), the CPU 81 at S37 stops driving of the output motor 299.

Since the information indicating that the leading-end positioning operation is to be performed is accepted (S39: YES), the CPU 81 at S41 controls the conveying motor 68 to perform the leading-end positioning operation for the succeeding printing medium 5B. For example, the CPU 81 at S41 conveys the succeeding printing medium 5B backward by a distance less than the third distance and greater than zero. After the execution of the processing at S41, the leading end portion of the succeeding printing medium 5B is positioned between the roller nipping position P2 and the printing position P1 in the conveying direction (see FIG. 22). In the case where the leading-end positioning operation is performed, the CPU 81 at S43 calculates and obtains a distance less than the fifth distance and greater than zero, as the conveying distance for the succeeding printing medium 5B.

The CPU 81 at S45 performs printing on the succeeding printing medium 5B. After conveying the succeeding printing medium 5B forward by the conveying distance obtained at S43, the CPU 81 stops the conveying motor 68 and the thermal head 60. At the end of the processing at S45, the leading end portion of the succeeding printing medium 5B is located on a rear side of the trailing end portion of the leading printing medium 5A (see FIG. 23). Since the information indicating the normal mode is accepted at S11 (S47: NO), the CPU 81 executes the processings at S49-S57.

In the main process in which the leading-end positioning operation is to be performed, the CPU 81 may at S11 accept zero as the discharging distance and at S43 obtain a conveying distance less than the fourth distance and greater than the fifth distance. In this case, as a result of the processing at S45, the leading end portion of the succeeding printing medium 5B overlaps the trailing end portion of the leading printing medium 5A in the right and left direction (see FIG. 17).

In the present embodiment as described above, even after the CPU 81 controls the output motor 299 to start discharging the leading printing medium 5A (S31, S33, S37), the leading printing medium 5A is kept nipped between the output roller 220 and the opposed roller 230. In the state in which the leading printing medium 5A is nipped, the CPU 81 at S45 performs printing on the succeeding printing medium 5B while conveying the succeeding printing medium 5B. When compared with a case where the CPU 81 conveys the succeeding printing medium 5B and performs printing on the succeeding printing medium 5B after the leading printing medium 5A comes out from between the output roller 220 and the opposed roller 230, the timing of the start of printing on the succeeding printing medium 5B is made earlier. Thus, the timing of the end of printing on the succeeding printing medium 5B is made earlier. This enables the printer 1 to perform printing on the printing medium 5 for a short time.

When the information indicating the normal mode is accepted (S11), and the leading-end positioning is not to be performed (S39: NO), the conveying distance by which the succeeding printing medium 5B is conveyed at S45 is less than the second distance and greater than zero. Thus, it is difficult for the leading end portion of the succeeding printing medium 5B conveyed downstream at S45, to contact the trailing end portion of the leading printing medium 5A. This enables the printer 1 to stably convey the succeeding printing medium 5B.

In the case where the user has operated the input interface 4 to input a distance greater than zero and less than the first distance (S11), the CPU 81 controls the output motor 299 to discharge the leading printing medium 5A (S31, S33, S37). Since the CPU 81 conveys the leading printing medium 5A downstream, it becomes difficult for the succeeding printing medium 5B conveyed at S45, to contact the leading printing medium 5A. This enables the printer 1 to stably convey the succeeding printing medium 5B.

In the case where the user has operated the input interface 4 to input the normal mode as the information indicating the print mode (S13), the CPU 81 at S45 starts performing printing on the succeeding printing medium 5B after controlling the output motor 299 to finish discharging the leading printing medium 5A. Thus, it becomes difficult for the succeeding printing medium 5B conveyed at S45, to contact the leading printing medium 5A. This enables the printer 1 to stably convey the succeeding printing medium 5B.

In the case where the user has operated the input interface 4 to input the information indicating the high-speed mode (S13), the CPU 81 at S45 starts conveying the printing medium 5 after the start of discharge of the leading printing medium 5A by the output motor 299 (S33) and before the end of discharge of the leading printing medium 5A by the output motor 299 (S49). Thus, the timing of the start of printing on the succeeding printing medium 5B is made earlier. This enables the printer 1 to perform printing on the printing medium 5 for a shorter time.

The speed of the succeeding printing medium 5B discharged in response to the processing at S31 is greater than the speed of the succeeding printing medium 5B conveyed at S45. Thus, it becomes difficult for the succeeding printing medium 5B to contact the leading printing medium 5A. This enables the printer 1 to stably convey the succeeding printing medium 5B.

The CPU 81 at S45 starts conveying the succeeding printing medium 5B after moving the full-cut blade 140 to the distant position (S29). This makes it difficult for the succeeding printing medium 5B to contact the full-cut blade 140, enabling the printer 1 to stably convey the succeeding printing medium 5B.

Even after the CPU 81 controls the output motor 299 to discharge the leading printing medium 5A (S33, S37), the leading printing medium 5A is kept nipped between the output roller 220 and the opposed roller 230. In the state in which the leading printing medium 5A is nipped, the CPU 81 at S41 conveys the succeeding printing medium 5B backward. When compared with a case where the CPU 81 conveys the succeeding printing medium 5B backward after the leading printing medium 5A comes out from between the output roller 220 and the opposed roller 230, the timing of the start of printing on the succeeding printing medium 5B is made earlier. Thus, the timing of the end of printing on the succeeding printing medium 5B is made earlier. This enables the printer 1 to perform printing on the printing medium 5 for a short time.

The CPU 81 at S41 conveys the succeeding printing medium 5B backward by the distance less than the third distance. Since the distance by which the succeeding printing medium 5B is conveyed backward in the conveying direction is less than the third distance and greater than zero, it is difficult for the leading end portion of the succeeding printing medium 5B to move to a position located upstream of the printing position P1. Thus, it is difficult for the leading end portion of the succeeding printing medium 5B to come out from between the platen roller 65 and the thermal head 60. This enables the printer 1 to stably convey the succeeding printing medium 5B downstream at S49.

The CPU 81 at S45 conveys the leading printing medium 5A by the distance less than the fourth distance and greater than zero. Since this conveying distance for the leading printing medium 5A is less than the fourth distance, the printer 1 can prevent the trailing end portion of the leading printing medium 5A from being excessively pushed by the leading end portion of the succeeding printing medium 5B.

In the case where the leading-end positioning is performed (S41), the CPU 81 at S45 conveys the leading printing medium 5A downstream by the distance less than the fifth distance. Thus, it becomes difficult for the trailing end portion of the leading printing medium 5A to contact the leading end portion of the succeeding printing medium 5B conveyed at S45. This enables the printer 1 to stably convey the succeeding printing medium 5B.

The user can at S 11 operate the input interface 4 to input the discharging distance for the succeeding printing medium 5B. The CPU 81 discharges the leading printing medium 5A by the discharging distance set selectively (S31, S33, S37). Since the user can set the conveying distance for the leading printing medium 5A, the usability of the printer 1 is increased.

Even when the output motor 299 is rotated forwardly, the power transmission between the output motor 299 and the moving mechanism 250 is disengaged by the one-way clutch 290. Thus, the moving mechanism 250 does not move the output roller 220 between the nip position and the release position. This configuration enables the printer 1 to rotate the output roller 220 in the discharging direction (indicated by arrow R3) in the state in which the output roller 220 is kept at the predetermined position. That is, by controlling the rotational direction of the one output motor 299, the printer 1 can control rotation of the output roller 220 in the discharging direction and movement of the output roller 220 between the nip position and the release position. This eliminates the need for the printer 1 to include a motor for rotating the output roller 220 in the discharging direction and a motor for moving the output roller 220 between the nip position and the release position. This can reduce increase in size of the printer 1.

The first coupling mechanism 280 includes the coupling gear 284 and the moving gear 285. The coupling gear 284 is power-transmittably coupled to the output motor 299. The moving gear 285 is provided on the rotation shaft 285A of the output roller 220 and engaged with the coupling gear 284. In any of the case where the output roller 220 is moved to the nip position and the case where the output roller 220 is moved to the release position, the moving mechanism 250 moves the rotation shaft 285A of the output roller 220 along the outer circumferential surface 284B on which the teeth of the coupling gear 284 are provided on. Thus, the output roller 220 is moved to any of the nip position and the release position in the state in which the moving gear 285 is engaged with the coupling gear 284. As a result, even when the output roller 220 is moved to any of the nip position and the release position, the driving force generated by the output motor 299 is transmitted to the coupling gear 284, the moving gear 285, and the output roller 220 in this order. Thus, even in the case where the output roller 220 is positioned at any of the nip position and the release position, the printer 1 can drive the output motor 299 to rotate the output roller 220 in the discharging direction (indicated by arrow R3).

The printer 1 includes the first frame 211. The first frame 211 has the guide hole 211A. The guide hole 211A extends along the outer circumferential surface 284B. The rotation shaft 285A of the output roller 220 is inserted in the guide hole 211A. With this configuration, in the case where the output roller 220 is moved to any of the nip position and the release position, the guide hole 211A guides the rotation shaft 285A of the output roller 220 along the outer circumferential surface 284B of the coupling gear 284. Thus, in the case where the output roller 220 is moved to any of the nip position and the release position, the printer 1 reliably keeps the moving gear 285 engaged with the coupling gear 284.

The moving mechanism 250 includes the rotor 251, the eccentric member 252, and the roller holder 255. The rotor 251 is coupled to the output motor 299 by the second coupling mechanism 240. The eccentric member 252 is secured to the rotor 251 so as to be eccentric to the rotation shaft 283A of the rotor 251. The roller holder 255 has the first support hole 266 and the second support hole 271. The first support hole 266 supports the eccentric member 252. The second support hole 271 supports the rotation shaft 285A of the output roller 220 such that the rotation shaft 285A is rotatable. Thus, the roller holder 255 supports the output roller 220. When the rotor 251 is rotated by the output motor 299, the eccentric member 252 is moved in the right and left direction. As a result, the eccentric member 252 moves the roller holder 255 in the right and left direction. The movement of the roller holder 255 in the right and left direction moves the output roller 220 in the right and left direction. Thus, the moving mechanism 250 is capable of moving the output roller 220 to any of the nip position and the release position.

The eccentric member 252 is supported by the first support hole 266 so as to be movable in the front and rear direction. The rotation shaft 285A of the output roller 220 is supported by the second support hole 271 so as to be movable in the front and rear direction. The front and rear direction of the printer 1 is orthogonal to each of the direction in which the rotation shaft 283A of the rotor 251 extends (the up and down direction of the printer 1) and the direction in which the roller holder 255 is moved (the right and left direction of the printer 1). With this configuration, even in the case where the eccentric member 252 is rotated about the rotation shaft 283A of the rotor 251, and the rotation shaft 285A of the output roller 220 is rotated about the rotation shaft 284A of the coupling gear 284, the rotation shafts 283A, 285A are movable in the front and rear direction with respect to the roller holder 255. Thus, in the case where the output roller 220 is moved between the nip position and the release position, the printer 1 need not make a manner of movement of the roller holder 255 the same as a manner of movement of the output roller 220 and the eccentric member 252. This increases the design flexibility of the roller holder 255.

In the case where the user has operated the input interface 4 to input the discharging distance greater than zero (S11), the CPU 81 controls the output motor 299 to convey the leading printing medium 5A forward by the discharging distance accepted at S11 (S33, S37) to establish a state in which the leading printing medium 5A is nipped between the output roller 220 and the opposed roller 230. Since the leading printing medium 5A is discharged toward the output opening 11, the leading printing medium 5A is taken out more easily. That is, the timing at which the leading printing medium 5A is taken out is made earlier. This enables the printer 1 to perform printing on the printing medium 5 for a short time.

In the above-described embodiment, the thermal head 60 is one example of a printing device. The cutting unit 100 is one example of a full-cut unit. The output roller 220 is one example of a roller. The opposed roller 230 is one example of a nip member. The output motor 299 is one example of a motor. The fixed blade 179 is one example of a medium support. The forward direction (indicated by arrow R1) is one example of a forward direction. The reverse direction (indicated by arrow R2) is one example of a reverse direction. The discharging direction (indicated by arrow R3) is one example of a first direction. The first coupling mechanism 280 is one example of a first coupling mechanism. The nip position is one example of a first position. The release position is one example of a second position. The moving mechanism 250 is one example of a moving mechanism. The one-way clutch 290 is one example of a switching mechanism. The second coupling mechanism 240 is one example of a second coupling mechanism. The coupling gear 284 is one example of a first gear. The rotation shaft 285A is one example of a rotation shaft of the roller. The moving gear 285 is one example of a second gear. The outer circumferential surface 284B is one example of an outer circumferential surface. The guide hole 211A is one example of a guide hole. The first frame 211 is one example of a guide member. The rotor 251 is one example of a rotor. The rotation shaft 283A is one example of a rotation shaft of the rotor. The eccentric member 252 is one example of an eccentric member. The first support hole 266 is one example of a first supporter. The second support hole 271 is one example of a second supporter. The roller holder 255 is one example of a holder. The front and rear direction of the printer 1 is one example of a second direction.

The processing at S27 is one example of a full-cut processing. The processings at S31, S33, S37 are one example of a particular processing. The processing at S45 is one example of a printing and conveying processing. The processing at S41 is one example of a backward conveying processing. The processing at S11 is one example of an obtaining processing.

While the embodiment has been described above, it is to be understood that the disclosure is not limited to the details of the illustrated embodiment, but may be embodied with various changes and modifications, which may occur to those skilled in the art, without departing from the spirit and scope of the disclosure. For example, the printing medium 5 may be a flexible tube instead of the tape. The discharging distance accepted at S11 may be less than the second distance and greater than zero. The main process may be configured such that the leading-end positioning operation is acceptable when the information indicating the high-speed mode is accepted. The output unit 200 may discharge the succeeding printing medium 5B (S33, S37) before the full-cut blade 140 is moved from the cutting position to the distant position. Printing on the succeeding printing medium 5B (S43) may be started before the start of movement of the full-cut blade 140 from the cutting position to the distant position.

In the case where the information indicating the normal mode is accepted (S13), and the leading-end positioning is not to be performed (S39: NO), the conveying distance by which the succeeding printing medium 5B is to be conveyed at S45 may be less than the first distance and greater than the second distance. In this case, the leading end portion of the succeeding printing medium 5B conveyed downstream at S45 is conveyed to a position overlapping the trailing end portion of the leading printing medium 5A in the right and left direction (see FIG. 17). Also in this case, since the conveying distance by which the succeeding printing medium 5B is to be conveyed at S45 is less than the first distance, the printer 1 can prevent the trailing end portion of the leading printing medium 5A from being excessively pushed upstream by the leading end portion of the succeeding printing medium 5B.

In the above-described embodiment, the CPU 81 at S25 controls the output motor 299 to move the output roller 220 to the nip position, at S27 drives the cutting motor 105 to cause the full-cut blade 140 to fully cut the printing medium 5, at S33 controls the output motor 299 to start discharging the leading printing medium 5A, and at S37 controls the output motor 299 to finish discharging the leading printing medium 5A. However, the present disclosure is not limited to these processings. For example, after cutting the printing medium 5 at S27, the CPU 81 may control the output motor 299 to temporaily move the output roller 220 to the release position and then move the output roller 220 to the nip position again. In another modification, the CPU 81 may omit the processing at S25 not to move the output roller 220 to the nip position and may at S27 drive the cutting motor 105 to cause the full-cut blade 140 to fully cut the printing medium 5 in the state in which the output roller 220 is not located at the nip position. In this case, the CPU 81 controls the output motor 299 to move the output roller 220 to the nip position after completion of the processing at S27.

A plurality of pieces of information about the discharging distances may be stored in the flash memory 82 in advance. In this case, the CPU 81 may obtain a predetermined distance from among the discharging distances stored in the flash memory 82, in accordance with the print mode accepted at S13, for example. The CPU 81 controls the output motor 299 to discharge the leading printing medium 5A by the obtained discharging distance (S33, S37). In this modification, the discharging distance for the leading printing medium 5A is changeable, thereby increasing the usability of the printer 1.

The takeout detecting sensor 32 may be provided downstream of the full-cut blade 140 and upstream of the output roller 220. In this case, the takeout detecting sensor 32 is capable of detecting whether the printing medium 5 is present between the full-cut position P3 and the nipping position P5. For example, in the case where the discharging distance accepted at Si 1 is zero, the CPU 81 can determine whether the leading printing medium 5A is taken out, based on the result of detection of the takeout detecting sensor 32 in the present modification (S51).

The output unit 200 may include a driving device different from the output motor 299 and the output motor 299. One example of the driving device is a solenoid that moves the output roller 220 between the nip position and the release position. The output motor 299 only has to be capable of rotating the output roller 220 in the discharging direction and the returning direction. In this case, the output unit 200 may not include the one-way clutch 290, and so on.

A device such as a microcomputer, an application-specific integrated circuit (ASIC), and a field-programmable gate array (FPGA) may be used as a processor instead of the CPU 81. The main process is executed by a plurality of processors, that is, distributed processing may be performed. The nonvolatile (non-transitory) storage medium may be any storage medium as long as the nonvolatile storage medium can store information regardless of a period in which the information is stored. The nonvolatile storage medium may not contain a volatile storage medium, e.g., a signal to be transmitted. The programs may be downloaded from a server connected to a network (that is, the programs may be transmitted as transmission signals) and stored into the flash memory 82, for example. In this case, the programs at least need to be stored in a nonvolatile storage medium such as a hard disc drive provided in a server.

What is claimed is:

1. A printer, comprising:

a conveyor configured to convey a printing medium;

a printing device configured to perform printing on the printing medium conveyed by the conveyor;

a full-cut unit provided downstream of the printing device in a conveying direction in which the printing medium is conveyed, the full-cut unit being configured to fully cut the printing medium;

a roller provided downstream of the full-cut unit in the conveying direction;

a nip member configured to cooperate with the roller to nip the printing medium therebetween;

a motor configured to drive the roller; and a controller configured to execute:

a full-cut processing in which the controller controls the full-cut unit to fully cut the printing medium into a leading printing medium located downstream of the full-cut unit in the conveying direction and a succeeding printing medium located upstream of the full-cut unit in the conveying direction;

a particular processing in which the controller controls the motor to establish a state in which the leading printing medium is nipped between the roller and the nip member; and a printing and conveying processing in which the controller controls the conveyor to convey the succeeding printing medium downstream in the conveying direction while controlling the printing device to perform printing on the succeeding printing medium in the state in which the leading printing medium is nipped between the roller and the nip member.

2. The printer according to claim 1, wherein the controller is configured to, in the printing and conveying processing, control the conveyor to convey the succeeding printing medium downstream in the conveying direction by a distance less than a first distance while controlling the printing device to perform printing on the succeeding printing medium, and the first distance is a distance in the conveying direction from a full-cut position at which the printing medium is fully cut by the full-cut unit, to a nipping position at which the printing medium is nipped between the roller and the nip member.

3. The printer according to claim 2, wherein the controller is configured to, in the printing and conveying processing, control the conveyor to convey the succeeding printing medium downstream in the conveying direction by a distance less than a second distance while controlling the printing device to perform printing on the succeeding printing medium, and the second distance is a distance in the conveying direction from the full-cut position to an upstream end portion of the leading printing medium in the conveying direction.

4. The printer according to claim 1, wherein the controller is configured to control the conveyor in the particular processing to convey the leading printing medium downstream in the conveying direction by a distance less than a first distance, and the first distance is a distance in the conveying direction from a full-cut position at which the printing medium is fully cut by the full-cut unit, to a nipping position at which the printing medium is nipped between the roller and the nip member.

5. The printer according to claim 4, wherein the controller is configured to start conveying the succeeding printing medium in the printing and conveying processing after the leading printing medium is conveyed in the particular processing by the distance less than the first distance.

6. The printer according to claim 4, wherein the controller is configured to start conveying the succeeding printing medium in the printing and conveying processing at a timing between a start and an end of conveyance of the leading printing medium in the particular processing.

7. The printer according to claim 6, wherein a speed of conveyance of the leading printing medium in the particular processing is greater than a speed of conveyance of the succeeding printing medium in the printing and conveying processing.

8. The printer according to claim 1, wherein the full-cut unit comprises:

a medium support configured to support the printing medium; and a full-cut blade movable between (i) a cutting position at which the printing medium is cut between the full-cut blade and the medium support and (ii) a distant position spaced apart from the cutting position, wherein the controller is configured to move the full-cut blade having fully cut the printing medium, from the cutting position to the distant position in the full-cut processing, and wherein the controller is configured to start conveying the succeeding printing medium in the printing and conveying processing after the full-cut blade is moved from the cutting position to the distant position in the full-cut processing.

9. The printer according to claim 1, wherein the controller is configured to control the motor to convey the leading printing medium downstream in the conveying direction in the particular processing.

10. A printer, comprising:

a conveyor configured to convey a printing medium;

a printing device configured to perform printing on the printing medium conveyed by the conveyor;

a full-cut unit provided downstream of the printing device in a conveying direction in which the printing medium is conveyed, the full-cut unit being configured to fully cut the printing medium;

a roller provided downstream of the full-cut unit in the conveying direction;

a nip member configured to cooperate with the roller to nip the printing medium therebetween;

a motor configured to drive the roller; and a controller configured to execute:

a full-cut processing in which the controller controls the full-cut unit to fully cut the printing medium into a leading printing medium located downstream of the full-cut unit in the conveying direction and a succeeding printing medium located upstream of the full-cut unit in the conveying direction;

a particular processing in which the controller controls the motor to establish a state in which the leading printing medium is nipped between the roller and the nip member; and a backward conveying processing in which the controller controls the conveyor to convey the succeeding printing medium upstream in the conveying direction in the state in which the leading printing medium is nipped between the roller and the nip member.

11. The printer according to claim 10, wherein the controller is configured to convey the succeeding printing medium upstream in the conveying direction in the backward conveying processing by a distance less than a third distance, and the third distance is a distance in the conveying direction from a full-cut position at which the printing medium is fully cut by the full-cut unit, to a printing position at which the printing device performs printing on the printing medium.

12. The printer according to claim 11, wherein the controller is configured to, after the succeeding printing medium is conveyed in the backward conveying processing, execute a printing and conveying processing in which the controller controls the conveyor to convey the succeeding printing medium downstream in the conveying direction by a distance less than a fourth distance while controlling the printing device to perform printing on the succeeding printing medium, and the fourth distance is a distance in the conveying direction from the printing position to a nipping position at which the printing medium is nipped between the roller and the nip member.

13. The printer according to claim 12, wherein the controller is configured to, in the printing and conveying processing, control the conveyor to convey the succeeding printing medium downstream in the conveying direction by a distance less than a fifth distance while controlling the printing device to perform printing on the succeeding printing medium, and the fifth distance is a distance in the conveying direction from the printing position to an upstream end portion of the leading printing medium in the conveying direction.

14. The printer according to claim 12, wherein the controller is configured to control the conveyor in the particular processing to convey the leading printing medium downstream in the conveying direction by a distance less than a first distance, and the first distance is a distance in the conveying direction from the full-cut position to the nipping position.

15. The printer according to claim 14, wherein the controller is configured to start conveying the succeeding printing medium in the printing and conveying processing after the leading printing medium is conveyed in the particular processing by the distance less than the first distance.

16. The printer according to claim 14, wherein the controller is configured to start conveying the succeeding printing medium in the printing and conveying processing at a timing between a start and an end of conveyance of the leading printing medium in the particular processing.

17. The printer according to claim 16, wherein a speed of conveyance of the leading printing medium in the particular processing is greater than a speed of conveyance of the succeeding printing medium in the printing and conveying processing.

18. The printer according to claim 10, wherein the controller is configured to control the motor to convey the leading printing medium downstream in the conveying direction in the particular processing.

19. The printer according to claim 10, wherein the full-cut unit comprises:

a medium support configured to support the printing medium; and a full-cut blade movable between (i) a cutting position at which the printing medium is cut between the full-cut blade and the medium support and (ii) a distant position spaced apart from the cutting position, wherein the controller is configured to move the full-cut blade having fully cut the printing medium, from the cutting position to the distant position in the full-cut processing, and wherein the controller is configured to start conveying the succeeding printing medium in the backward conveying processing after the full-cut blade is moved from the cutting position to the distant position in the full-cut processing.

20. The printer according to claim 1, wherein the controller is configured to execute an obtaining processing in which the controller obtains one of a plurality of distances different from each other to convey the leading printing medium downstream in the conveying direction, and wherein the controller is configured to, in the particular processing, convey the leading printing medium downstream in the conveying direction by the distance obtained in the obtaining processing.

21. The printer according to claim 20, wherein the controller is configured to obtain the distance set selectively.

22. The printer according to claim 1, further comprising:

a first coupling mechanism configured to establish power transmission between the motor and the roller and rotate the roller in a first direction to convey the printing medium downstream in the conveying direction when the motor is rotated in a forward direction;

a moving mechanism configured to move the roller selectively to one of a first position at which the printing medium is nipped between the roller and the nip member and a second position at which the roller is spaced apart from the printing medium; and a second coupling mechanism configured to establish power transmission between the motor and the moving mechanism and comprising a switching mechanism configured to:

establish power transmission between the motor and the moving mechanism when the motor is rotated in a reverse direction reverse to the forward direction; and disengage the power transmission between the motor and the moving mechanism when the motor is rotated in the forward direction.

23. The printer according to claim 22, wherein the first coupling mechanism comprises:

a first gear coupled to the motor power-transmittably; and a second gear provided on a rotation shaft of the roller and engaged with the first gear, and wherein the moving mechanism is configured to, when the roller is moved to the first position and the second position, move the rotation shaft of the roller along an outer circumferential surface on which a tooth of the first gear is provided.

24. The printer according to claim 23, further comprising a guide member formed with a guide hole which extends along the outer circumferential surface and in which the rotation shaft of the roller is inserted.

25. The printer according to claim 23, wherein the moving mechanism comprises:

a rotor coupled to the motor by the second coupling mechanism;

an eccentric member secured to the rotor so as to be eccentric to a rotation shaft of the rotor; and a holder comprising: a first supporter configured to support the eccentric member; and a second supporter configured to support the rotation shaft of the roller such that the rotation shaft of the roller is rotatable.

26. The printer according to claim 25, wherein the first supporter is a hole that supports the eccentric member such that the eccentric member is movable in a second direction orthogonal to each of a direction in which the rotation shaft of the rotor extends and a direction in which the holder is moved, and wherein the second supporter is a hole that supports the rotation shaft of the roller such that the rotation shaft of the roller is movable in the second direction.

27. A printer, comprising:

a conveyor configured to convey a printing medium;

a printing device configured to perform printing on the printing medium conveyed by the conveyor;

a full-cut unit provided downstream of the printing device in a conveying direction in which the printing medium is conveyed, the full-cut unit being configured to fully cut the printing medium;

a roller provided downstream of the full-cut unit in the conveying direction;

a nip member configured to cooperate with the roller to nip the printing medium therebetween;

a motor configured to drive the roller; and a controller configured to execute:

a full-cut processing in which the controller controls the full-cut unit to fully cut the printing medium into a leading printing medium located downstream of the full-cut unit in the conveying direction and a succeeding printing medium located upstream of the full-cut unit in the conveying direction;

an obtaining processing in which the controller obtains one of a plurality of pieces of distance information which are different from each other and each of which indicates a distance less than a first distance in the conveying direction from a full-cut position at which the printing medium is fully cut by the full-cut unit, to a nipping position at which the printing medium is nipped between the roller and the nip member; and a particular processing in which the controller controls the motor to convey the leading printing medium downstream in the conveying direction by a distance indicated by the distance information obtained in the obtaining processing, to establish a state in which the leading printing medium is nipped between the roller and the nip member.

* * * * *